US009538595B2

(12) United States Patent
Chang et al.

(10) Patent No.: US 9,538,595 B2
(45) Date of Patent: Jan. 3, 2017

(54) ILLUMINATION DEVICE AND LIGHT-EMITTING DIODE CIRCUIT

(71) Applicant: Lextar Electronics Corporation, Hsinchu (TW)

(72) Inventors: Chun-Jong Chang, Hsinchu County (TW); Jhao-Cyuan Huang, New Taipei (TW); Po-Shen Chen, Hsinchu (TW); Chien-Nan Yeh, Kaohsiung (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 14/953,410

(22) Filed: Nov. 29, 2015

(65) Prior Publication Data

US 2016/0174315 A1 Jun. 16, 2016

(30) Foreign Application Priority Data

Dec. 10, 2014 (TW) ..... 103143039 A
Jul. 21, 2015 (TW) ..... 104123587 A

(51) Int. Cl.
*H05B 37/00* (2006.01)
*H05B 33/08* (2006.01)

(52) U.S. Cl.
CPC ..... *H05B 33/0824* (2013.01); *H05B 33/0809* (2013.01)

(58) Field of Classification Search
CPC ..... H05B 33/0824; H05B 33/0809
USPC ..... 315/191, 192, 193, 186, 201, 297, 307
See application file for complete search history.

(56) References Cited

U.S. PATENT DOCUMENTS

2006/0232219 A1 10/2006 Xu
2010/0308739 A1 12/2010 Shteynberg et al.
2011/0127922 A1* 6/2011 Sauerlaender ..... H05B 33/0809 315/192
2012/0194088 A1 8/2012 Pan et al.
(Continued)

FOREIGN PATENT DOCUMENTS

CN 102781138 A * 11/2012
CN 203219546 U 9/2013
(Continued)

OTHER PUBLICATIONS

Chen, Ruizhen, English Machine Translation of CN 102781138A, Pubished Nov. 14, 2012, pp. 1-8.*

*Primary Examiner* — Daniel D Chang
(74) *Attorney, Agent, or Firm* — CKC & Partners Co., Ltd.

(57) ABSTRACT

An illumination device includes a rectifier circuit, M light-emitting modules, and a control module. The rectifier circuit has a positive output terminal and a negative output terminal, and generates a driving voltage between the positive output terminal and the negative output terminal according to an input power. The M light-emitting modules are coupled between the positive output terminal and the negative output terminal. Each of the M light-emitting modules has a conduction voltage, and includes a light-emitting unit that includes at least one light-emitting diode. The control module is coupled between the rectifier circuit and the M light-emitting modules, and controls the M light-emitting modules to dynamically form S light-emitting diode strings coupled in parallel with each other. A number of the light-emitting units in each of the S light-emitting diode strings is N, in which S×N=M, where M, S, N are positive integers.

26 Claims, 14 Drawing Sheets

(56) References Cited

U.S. PATENT DOCUMENTS

| | | | | |
|---|---|---|---|---|
| 2012/0299490 | A1* | 11/2012 | Lee | H05B 33/0824 315/191 |
| 2013/0002141 | A1 | 1/2013 | Lee | |
| 2014/0062323 | A1* | 3/2014 | Pan | H05B 33/0806 315/200 R |
| 2014/0097753 | A1 | 4/2014 | Hui et al. | |

FOREIGN PATENT DOCUMENTS

| | | | |
|---|---|---|---|
| KR | 20140132215 | A | 11/2014 |
| TW | 201143519 | A | 12/2011 |
| TW | M448871 | U | 3/2013 |
| TW | 201352058 | A | 12/2013 |
| TW | I425661 | B | 2/2014 |
| TW | I436682 | B | 5/2014 |
| TW | I448190 | B | 8/2014 |

* cited by examiner

| $V_D$ | S[1.] | S[2+] | S[2.] | S[3+] | S[3.] | S[4+] | S[4.] | S[5+] | S[5.] | S[6+] | S[6.] | S[7+] | S[7.] | S[8+] | S[8.] | S[9+] | S[9.] | S[10+] | S[10.] | S[11+] | S[11.] | S[12+] |
|---|---|---|---|---|---|---|---|---|---|---|---|---|---|---|---|---|---|---|---|---|---|---|
| $12\times V_F$ | | | | | | | | | | | | | | | | | | | | | | |
| $11\times V_F$ | | | | | | | | | | | ON | ON | | | | | | | | | | |
| $10\times V_F$ | | | | | | | | | | | ON | ON | | | | | | | | | | |
| $9\times V_F$ | | | | | | | | | | | ON | ON | | | | | | | | | | |
| $8\times V_F$ | | | | | | | | | | | ON | ON | | | | | | | | | | |
| $7\times V_F$ | | | | | | | | | | | ON | ON | | | | | | | | | | |
| $6\times V_F$ | | | | | | | | | | | ON | ON | | | | | | | | | | |
| $5\times V_F$ | | | | | | | ON | ON | | | | | | | ON | ON | | | | | | |
| $4\times V_F$ | | | | | | | ON | ON | | | | | | | ON | ON | | | | | | |
| $3\times V_F$ | | | | | ON | ON | | | | | | | | | | | ON | ON | | | | |
| $2\times V_F$ | | | ON | ON | | | ON | ON | | | ON | ON | | | ON | ON | | | ON | ON | | |
| $1\times V_F$ | ON | ON | ON | ON | ON | ON | ON | ON | ON | ON | ON | ON | ON | ON | ON | ON | ON | ON | ON | ON | ON | ON |

FIG. 7

| $V_D$ | S[1-] | S[2+] | S[2-] | S[3+] | S[3-] | S[4+] | S[4-] | S[5+] | S[5-] | S[6+] | S[6-] | S[7+] | S[7-] | S[8+] | S[8-] | S[9+] | S[9-] | S[10+] | S[10-] | S[11+] | S[11-] | S[12+] |
|---|---|---|---|---|---|---|---|---|---|---|---|---|---|---|---|---|---|---|---|---|---|---|
| $12\times V_F$ | | | | | | | | | | | | | | | | | | | | | | |
| $11\times V_F$ | | | | | | | | | | | ON | ON | | | | | | | | | | |
| $10\times V_F$ | | | | | | | | | | | ON | ON | | | | | | | | | | |
| $9\times V_F$ | | | | | | | | | | | ON | ON | | | | | | | | | | |
| $8\times V_F$ | | | | | | | | | | | ON | ON | | | | | | | | | | |
| $7\times V_F$ | | | | | | | | | | | ON | ON | | | | | | | | | | |
| $6\times V_F$ | | | | | | | | | | | ON | ON | | | | | | | | | | |
| $5\times V_F$ | | ON | | | | | | | | | ON | ON | | | | | | | | | ON | |
| $4\times V_F$ | | | | | | | ON | ON | | | | | | | ON | ON | | | | | | |
| $3\times V_F$ | | | | | ON | ON | | | | | | | | | | | ON | ON | | | | |
| $2\times V_F$ | | | ON | ON | | | ON | ON | | | ON | ON | | | ON | ON | | | ON | ON | | |
| $1\times V_F$ | ON | ON | ON | ON | ON | ON | ON | ON | ON | ON | ON | ON | ON | ON | ON | ON | ON | ON | ON | ON | ON | ON |

FIG. 8

ILLUMINATION DEVICE AND LIGHT-EMITTING DIODE CIRCUIT

RELATED APPLICATIONS

This application claims priority to Taiwanese Application Serial Number, 103143039, filed Dec. 10, 2014, which is herein incorporated by reference. This application also claims priority to Taiwanese Application Serial Number, 104123587, filed Jul. 21, 2015, which claims priority to Taiwanese Application Serial Number, 103143039, filed Dec. 10, 2014. Aforementioned applications are herein incorporated by reference.

BACKGROUND

Technical Field

The present disclosure relates to an illumination device. More particularly, the present disclosure relates to an illumination device having light-emitting modules that can be adapted to a driving voltage.

Description of Related Art

Recently, light-emitting diodes (LEDs) have been widely applied in various illumination devices, such as home lighting, headlights, electric torches, backlight in display panels, etc.

In some approaches, illumination devices using LEDs as the light-emitting elements cannot effectively kept all LEDs being lighted simultaneously with different driving voltages. As a result, the effective usage of the LEDs is reduced. Moreover, the current illumination devices cannot effectively achieve the constant-power to drive LED under different driving voltages.

Therefore, a heretofore-unaddressed need exists in this industry to improve the illumination devices for not only keeping all of the LEDs being lighted simultaneously within a wide range of driving voltage, but also achieving the constant-power to drive LED.

SUMMARY

An aspect of the present disclosure is to provide an illumination device. The illumination device includes a rectifier circuit, M light-emitting modules, and a control module. The rectifier circuit has a positive output terminal and a negative output terminal, and is configured to generate a driving voltage between the positive output terminal and the negative output terminal according to an input power. The M light-emitting modules are coupled between the positive output terminal and the negative output terminal. Each of the M light-emitting modules has a conduction voltage, and includes a light-emitting unit that includes at least one light-emitting diode. The control module is coupled between the rectifier circuit and the M light-emitting modules to detect the driving voltage, and is configured to control the M light-emitting modules to dynamically form S light-emitting diode strings coupled in parallel with each other according to the driving voltage and the conduction voltage. A number of the light-emitting units in each of the S light-emitting diode strings is N, and S×N, where M, S, N are positive integers.

Yet another aspect of the present disclosure is to provide a light-emitting diode circuit. The light-emitting diode circuit includes M light-emitting modules that are coupled in series and are between a positive output terminal and a negative output terminal of a rectifier circuit. Each of the M light-emitting modules includes a light-emitting unit, the light-emitting unit having a first terminal and a second terminal. An n-th light-emitting module of the M light-emitting modules includes a first rectifying diode, a first switch, and a second switch. A cathode of the first rectifying diode is coupled to the first terminal of the light-emitting unit of the n-th light-emitting module. The first switch is coupled between the positive output terminal and the cathode of the first rectifying diode, and is configured to be selectively turned on according to an n-th one of first control signals. The second switch is coupled between the negative output terminal and the second terminal of the light-emitting unit of the n-th light-emitting module, and is configured to be selectively turned on according to an n-th one of second control signals, where n is a positive integer greater than 1 and smaller than M.

One aspect of the present discourse is to provide an illumination device. The illumination device includes a rectifier circuit, a control module, M light-emitting modules, and a diode matrix. The rectifier circuit has a positive output terminal and an negative output terminal, and is configured to generate a driving voltage between the positive output terminal and the negative output terminal according to an input power. The control module is coupled between the positive output terminal and the negative output terminal. Each of the M light-emitting modules has a conduction voltage, and includes a light-emitting unit that includes at least one light-emitting diode. The diode matrix includes diodes that are coupled between the control module and the M light-emitting modules. The control module is configured to detect the driving voltage and turn on at least one of the diodes according to the driving voltage and the conduction voltage, to control the M light-emitting modules to dynamically form S light-emitting diode strings coupled in parallel with each other. The number of the light-emitting units in each of the S light-emitting diode strings is N, and S×N=M, where M, S, N are positive integers.

In sum, the illumination device, the circuit of the light-emitting module and the control method thereof provided in the present disclosure are applicable to a wide range of driving voltage, and the connections between the LEDs in the illumination device can be dynamically adjusted to achieve the operations of being lighted simultaneously under different voltages. Further, the circuits provided in this present disclosure can be widely applied to the dimming circuits with linear-driving.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows:

FIG. 7 is a second look up table illustrating the status of each switch in twelve light-emitting modules according to some embodiments of the present disclosure;

FIG. 8 is a third look up table illustrating the status of each switch in twelve light-emitting modules according to some embodiments of the present disclosure;

DETAILED DESCRIPTION

Figure 1:
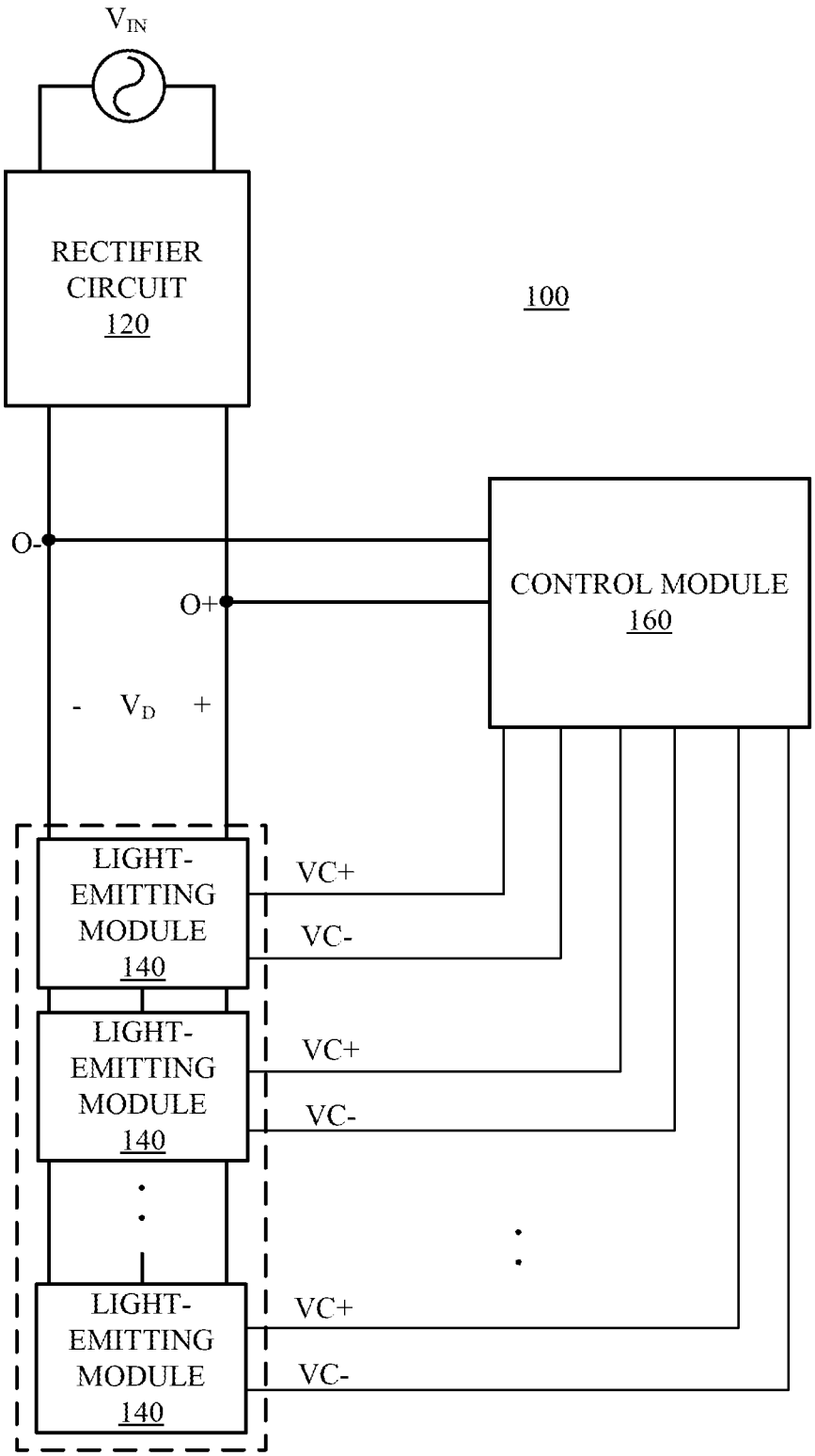
FIG. 1 is a schematic diagram of a illumination device according to some embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

Although the terms "first," "second," etc., may be used herein to describe various elements, these elements should not be limited by these terms. These terms are used to distinguish one element from another.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

In this document, the term "coupled" may also be termed as "electrically coupled", and the term "connected" may be termed as "electrically connected". "Coupled" and "connected" may also be used to indicate that two or more elements cooperate or interact with each other.

In this document, when a switch is described to be "turned on", a signal can be transmitted from a first terminal of the switch to a second terminal of the switch. Relatively, when the switch is described to be "turned off", a signal cannot be transmitted from the first terminal of the switch to the second terminal of the switch. For illustration, in some embodiments of the drawings below, when the switch is shown as being closed, the status of the switch is referred to as being turned on. Alternatively, in the embodiments of the drawings below, when the switch is shown as being opened, the status of the switch is referred to as being turned off. The illustrations of the switches in the drawings below are given for illustrative purposes. Various arrangements of the switches are within contemplated scope of the present disclosure.

Reference is now made to FIG. 1. FIG. 1 is a schematic diagram of an illumination device according to some embodiments of the present disclosure. As shown in FIG. 1, the illumination device 100 includes a rectifier circuit 120, light-emitting modules 140, and a control module 160.

As shown in FIG. 1, the rectifier circuit 120 has a positive output terminal O+ and a negative output terminal O−. The rectifier circuit 120 is configured to receive an input power $V_{IN}$, such as AC mains, to generate a driving voltage $V_D$ between the positive output terminal O+ and the negative output terminal O−. In various embodiments, the rectifier circuit 120 can be various types of half-wave or full-wave rectifier circuits, such as a bridge rectifier circuit, etc. This example is given for illustrative purposes only, and the present disclosure is not limited in this regard, and other types of circuits are also applicable to the illumination device 100.

The light-emitting modules 140 are coupled in series to form a light-emitting diode (LED) circuit, and are coupled between the positive output terminal O+ and the negative output terminal O−. The light-emitting module 140 includes a light-emitting unit, such as a light-emitting unit 142[*n*] illustrated in FIG. 2. The light-emitting unit can be driven by the driving voltage $V_D$ to emit light, and each of the light-emitting units includes at least one LED.

The control module 160 is coupled between the rectifier circuit 120 and the light-emitting modules 140. In various embodiments, the control module 160 is a digital signal processor, a digital controller, or related combinational logic circuits, but the present disclosure is not limited thereto.

In greater detail, the control module 160 is coupled between the positive output terminal O+ and the negative output terminal O− to detect the driving voltage $V_D$, and generates control signals VC+ and control signals VC− according to the driving voltage $V_D$. In various embodiments, the control signals VC+ and the control signals VC− are digital signals with a high logic value or a low logic value. The light-emitting modules 140 can dynamically switch connections between the light-emitting modules 140 according to the control signals VC+ and the control signals VC−, so as to form LED strings (not shown) that are coupled in parallel with each other. Through such arrangement, the light-emitting modules 140 can be kept emitting light simultaneously with different driving voltages $V_D$. For example, the illumination device 100 includes M light-emitting modules 140. The M light-emitting modules 140 can form S LED strings that coupled in parallel with each other according to the control signals VC+ and the control signals VC−, and the number of the light-emitting units in each LED string is N, where S×N=M, and M, S, N are positive integers. Relate operations are described below.

Figure 2:
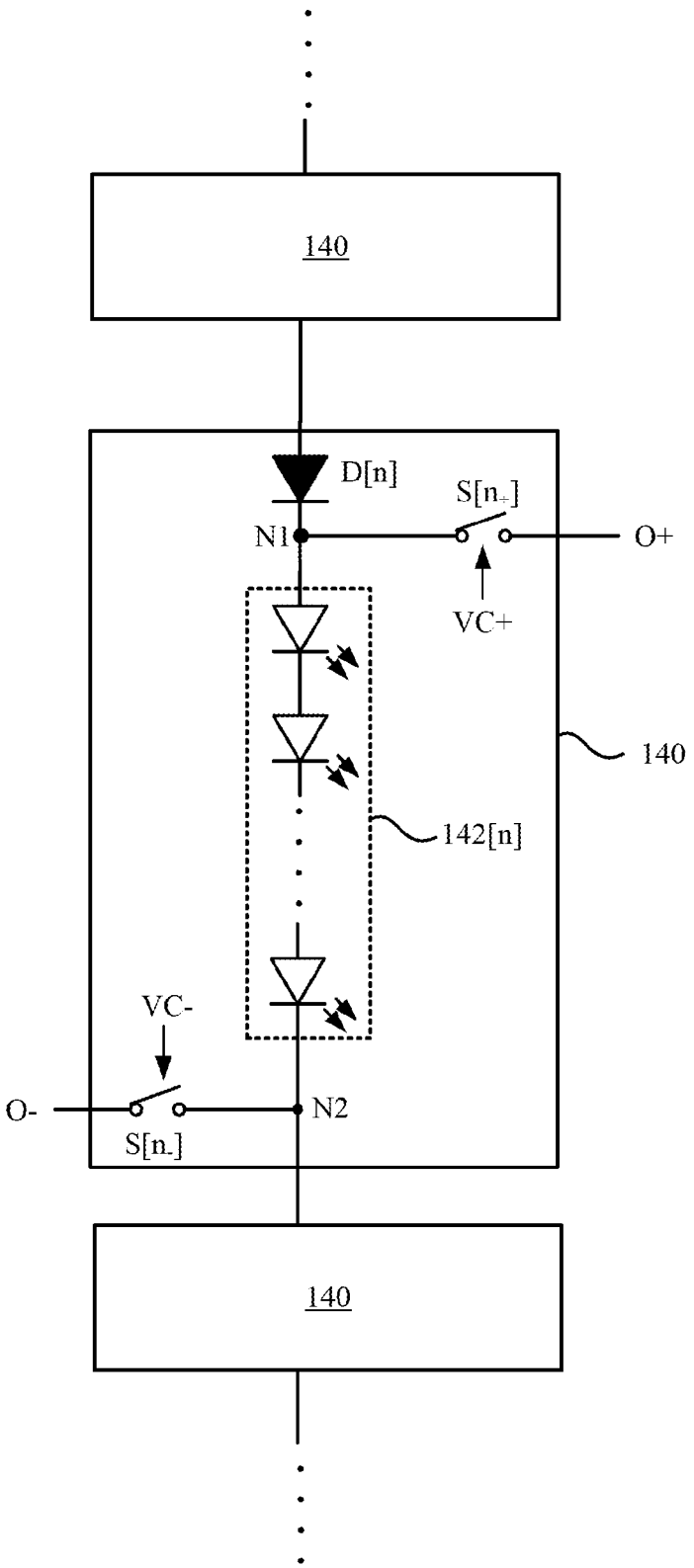
FIG. 2 is a circuit diagram of the light-emitting module shown in FIG. 1 according to some embodiments of the present disclosure.

Reference is now made to FIG. 2. FIG. 2 is a circuit diagram of the light-emitting module shown in FIG. 1 according to some embodiments of the present disclosure. For simplicity, an n-th light-emitting module 140 of the M light-emitting modules is illustrated as an example, in which n is a positive integer greater than 1 and smaller than M. As shown in FIG. 2, the n-th light-emitting module 140 includes a rectifying diode D[n], a switch $S[n_+]$, a switch S[n_], and a light-emitting unit 142[*n*]. The light-emitting unit 142[*n*] is coupled to the positive output terminal O+ via the switch $S[n_+]$, and is coupled to the negative output terminal O− via the switch S[n_].

The light-emitting unit 142[*n*] has a first terminal N1 and a second terminal N2. A cathode of the rectifying diode D[n] is coupled to the first terminal N1 of the light-emitting unit 142[*n*], and an anode of the rectifying diode D[n] is coupled to the second terminal N2 of a (n−1)-th light-emitting unit 142[*n*−1] (not shown) of the (n−1)-th light-emitting module 140. A first terminal of the switch S[$n_+$] is coupled to the positive output terminal O+, a second terminal of the switch S[$n_+$] is coupled to the cathode of the rectifying diode D[n] and the first terminal N1 of the light-emitting unit 142[*n*], and a control terminal of the switch S[$n_+$] is configured to receive the corresponding control signal VC+. A first terminal of the switch S[n_] is coupled to the second terminal N2 of the light-emitting unit 142[*n*], a second terminal of the switch S[n_] is coupled to the negative output terminal O−, and a control terminal of the switch S[n_] is configured to receive the corresponding control signal VC−. The second terminal N2 of the light-emitting unit 142[*n*] is further coupled to the anode (not shown) of the rectifying diode D[n+1] (not shown) of the (n+1)-th light-emitting module 140.

In greater detail, the anode of the rectifying diode D[1] (not shown) of the first light-emitting module 140 is coupled to the positive output terminal O+, and the second terminal of the switch S[m−] (not shown) of the M-th light-emitting module is coupled to the negative output terminal O−. As a result, all of the M light-emitting modules 140 are coupled between the positive output terminal O+ and the negative output terminal O−.

In some other embodiments, the light-emitting unit 142[*n*] is able to only include a single LED. In some embodiments, the light-emitting unit 142[*n*] includes LEDs coupled in series. Taking FIG. 2 as an example, the first terminal N1 of the light-emitting unit 142[*n*] is coupled to an anode of a first LED, and the second terminal N2 of the light-emitting unit 142[*n*] is coupled to a cathode of the last LED. For simplicity, the following embodiments are illustratively described with reference to the light-emitting unit 142[*n*] having a single LED, but the present disclosure is not limited in this regard. Those skilled in the art are able to adjust the number of the LEDs of the light-emitting unit 142[*n*] according requirements of actual applications.

Moreover, in various embodiments, the switch S[$n_+$] and the switch S[n_] are various types of transistors, such as bipolar junction transistors, field-effect transistors, etc. For illustration, in some embodiments, the switch S[$n_+$] is implemented with a metal oxide field-effect transistor (MOSFET), in which the first terminal of the switch S[$n_+$] is the drain of the MOSFET, the second terminal of the switch S[$n_+$] is the source of the MOSFET, and the control terminal of the switch S[$n_+$] is the gate of the MOSFET.

In some embodiments, each of the light-emitting modules 140 has a conduction voltage $V_F$. In further embodiments, the conduction voltage $V_F$ is the sum of forward voltages of the LEDs in the light-emitting unit 142[*n*]. For example, when the light-emitting unit 142[*n*] only includes a single LED, the conduction voltage $V_F$ is then equal to the forward voltage of the single LED. When the voltage applied between the first terminal N1 and the second terminal N2 of the light-emitting unit 142[*n*] is greater than the conduction voltage $V_F$, the light-emitting unit 142 is thus lit. In various embodiments, the control module 160 compares the driving voltage $V_D$ with the conduction voltage $V_F$ to generate the corresponding control signals VC+ and the corresponding control signals VC−.

With such arrangement, the switch S[$n_+$] can be selectively turned on according to the corresponding control signal VC+, and the switch S[n_] can be selectively turned on according to the corresponding control signal VC−. As a result, the internal connection between the light-emitting modules 140 can be dynamically switched with different driving voltages $V_D$ to form different numbers of the LED strings, and thus the operation of emitting light simultaneously is kept.

Figure 3A:
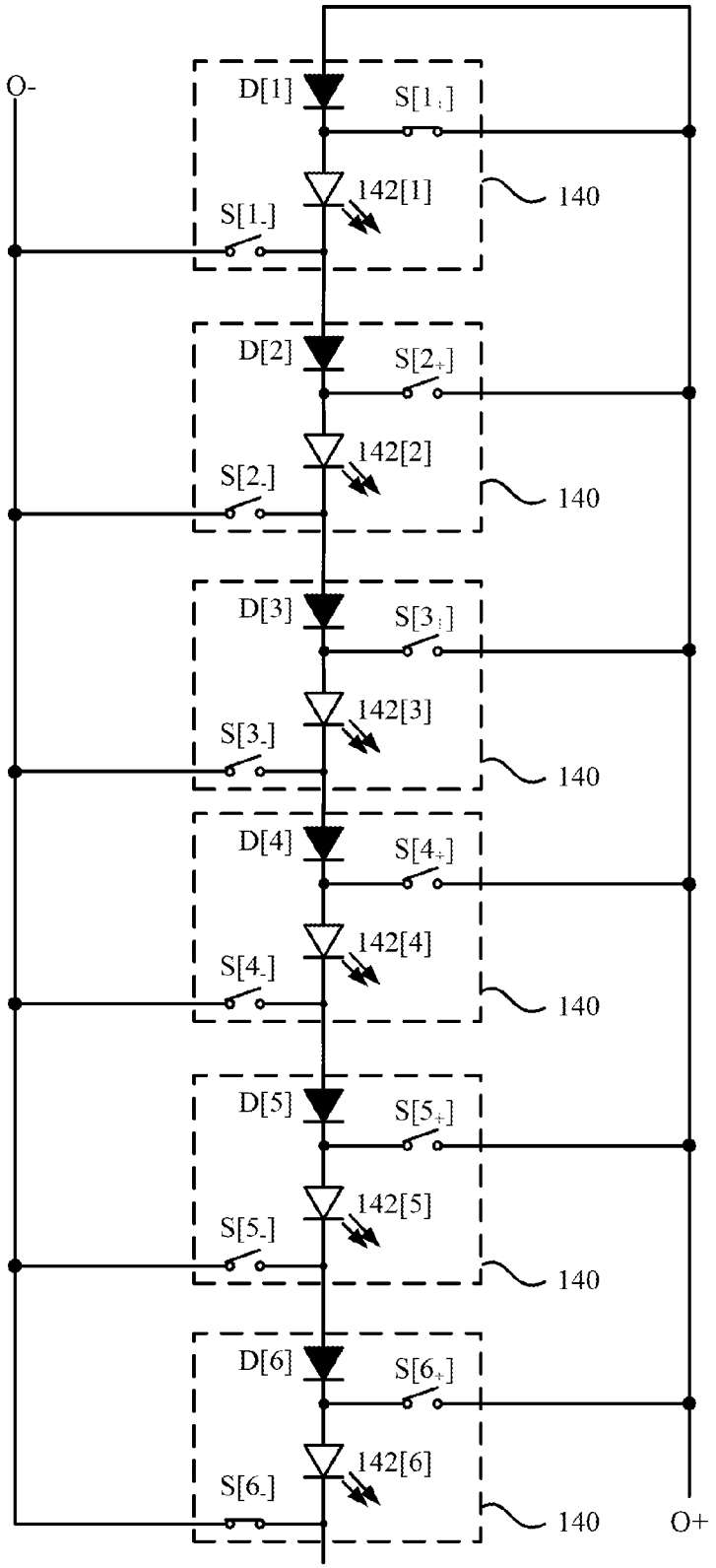
FIG. 3A is a schematic diagram of six light-emitting modules coupled in series according to some embodiments of the present disclosure.

Reference is now made to FIG. 3A. FIG. 3A is a schematic diagram of six light-emitting modules coupled in series according to some embodiments of the present disclosure. For example, as shown in FIG. 3A, the illumination device 100 has six light-emitting modules 140, in which the six light-emitting modules 140 are coupled in series between the positive output terminal O+ and the negative output terminal O−. In various embodiments, in order to enable the six light-emitting modules 140 which are coupled in series to perform correctly, the switch S[$\mathbf{1}_+$] of the first light-emitting module 140 is configured to be turned on, and the switch S[6_] of the six-th light-emitting module 140 is also configured to be turned on.

Figure 3B:
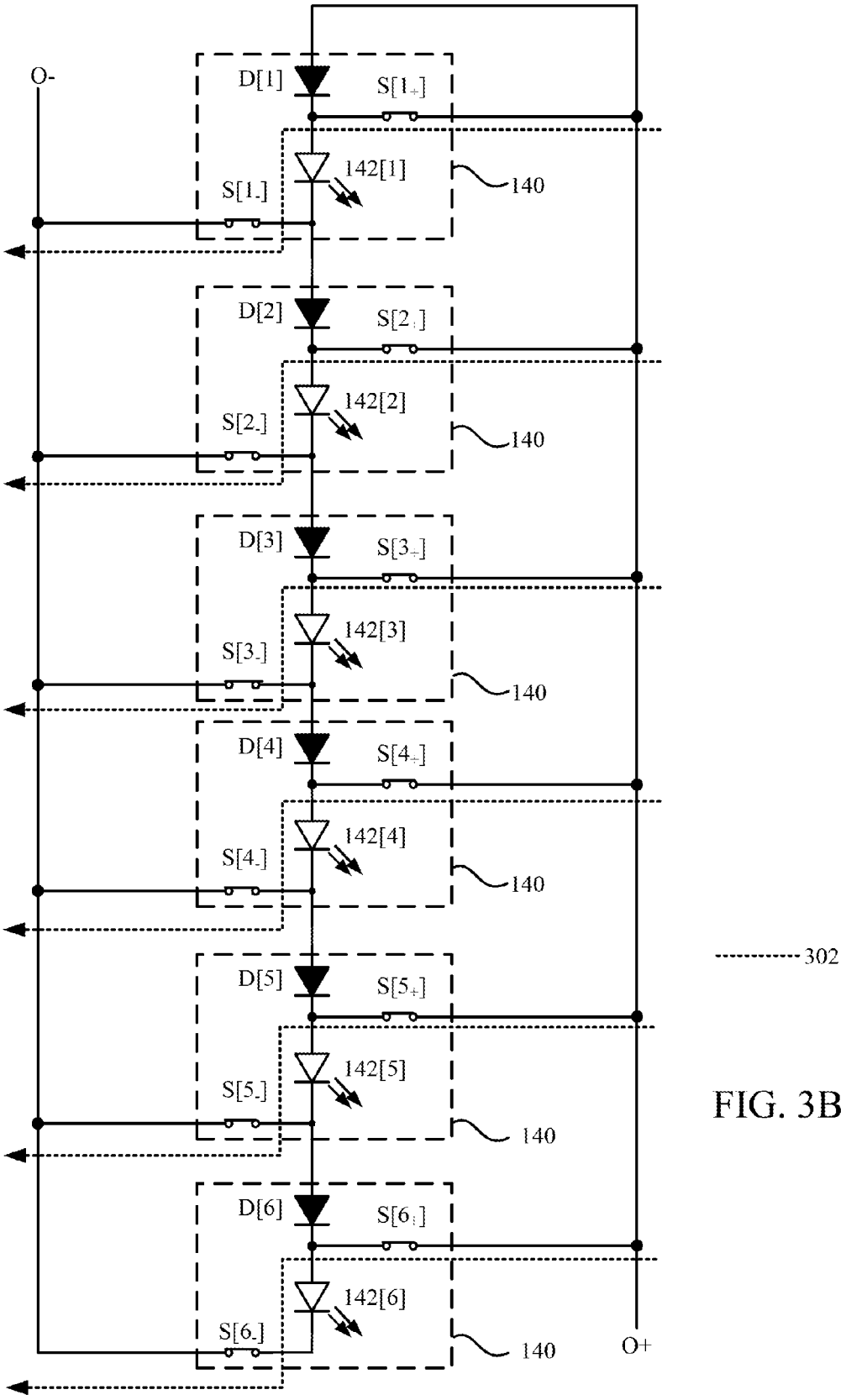
FIG. 3B is a schematic diagram illustrating a conducting status of the light-emitting modules in FIG. 3A according to some embodiments of the present disclosure.

Reference is now made to FIG. 3B. FIG. 3B is a schematic diagram illustrating a conducting status of the light-emitting modules in FIG. 3A according to some embodiments of the present disclosure. As shown in FIG. 3B, when the driving voltage $V_D$ is same as the conduction voltage $V_F$, the control module 160 accordingly outputs the control signals VC+ and the control signals VC−, so as to turn on the switches S[$\mathbf{1}_+$]-S[$\mathbf{6}_+$] and the switches S[1_]-S[6_] (i.e., as illustrated with the conducting path 302). Under this circumstance, the connection mode of the six light-emitting modules 140 forms six LED strings that are coupled in parallel with each other, and the number of the light-emitting units 142[*n*] in each LED string is one.

In greater detail, as shown in FIG. 3B, the first LED string includes a turned-on light-emitting unit 142[1], the second LED string includes a turned-on light-emitting unit 142[2], the third LED string includes a turned-on light-emitting unit 142[3], the fourth LED string includes a turned-on light-emitting unit 142[4], the fifth LED string includes a turned-on light-emitting unit 142[5], and the sixth LED string includes a turned-on light-emitting unit 142[6]. The six LED strings are coupled between the positive output terminal O+ and the negative output terminal O−, and are coupled in parallel with each other.

Figure 3C:
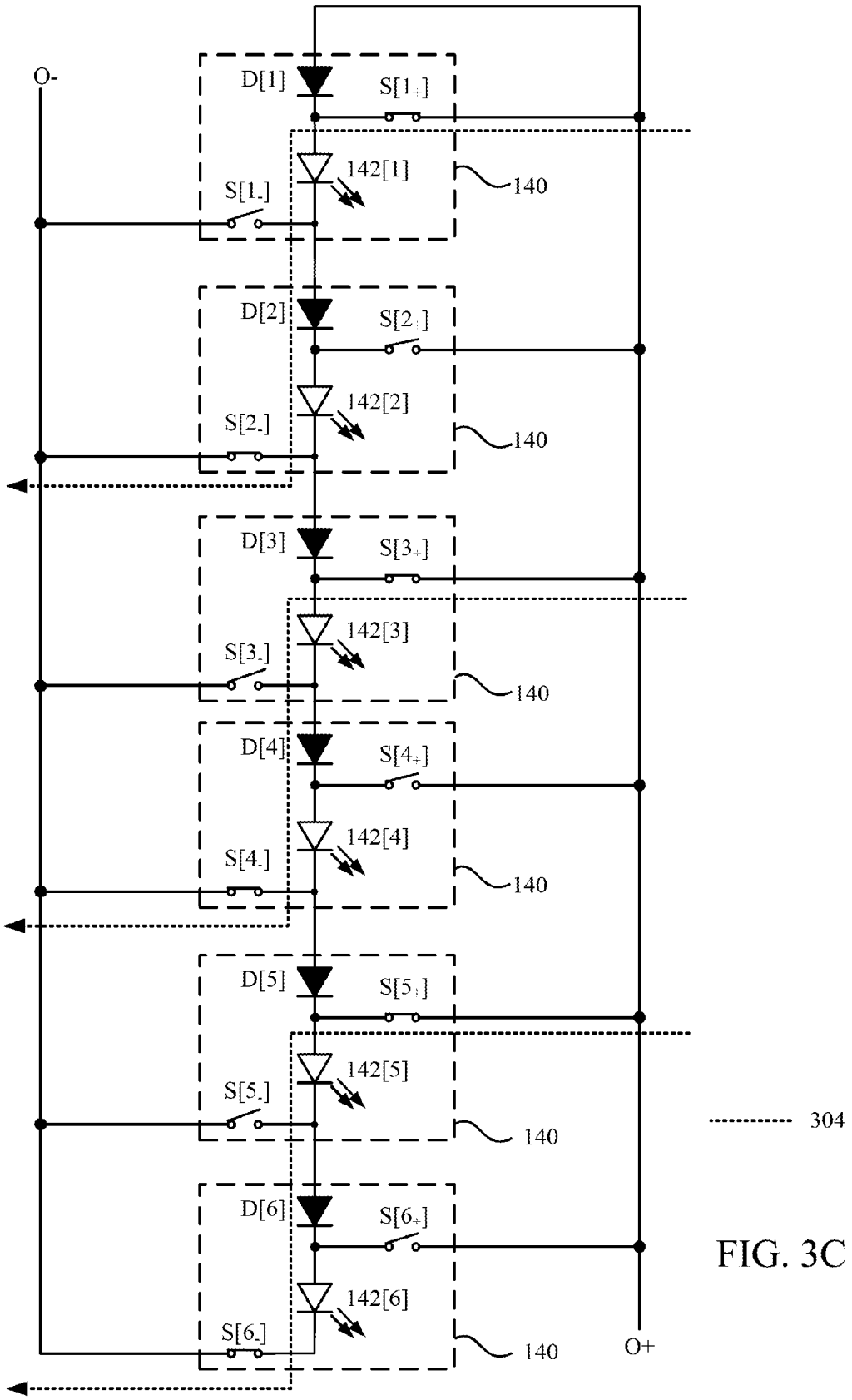
FIG. 3C is a schematic diagram illustrating a conducting status of the light-emitting modules in FIG. 3A according to another embodiment of the present disclosure.

Reference is now made to FIG. 3C. FIG. 3C is a schematic diagram illustrating a conducting status of the light-emitting modules in FIG. 3A according to another embodiment of the present disclosure. Alternatively, as shown in FIG. 3C, when the driving voltage $V_D$ is twice as much as the conduction voltage $V_F$, the control module 160 accordingly outputs the control signals VC+ and the control signals VC−, so as to turn on the switch S[2_], the switch S[$\mathbf{3}_+$], the switch S[4_], and the switch S[$\mathbf{5}_+$] (i.e., as illustrated with the conducting path 304), and the switch S[$\mathbf{1}_+$] and the switch S[6_] are already turned on. Under this circumstance, the connection mode of the six light-emitting modules 140 forms three LED strings that are coupled in parallel with each other, and the number of the light-emitting units 142[*n*] in each LED string is two.

In greater detail, as shown in FIG. 3C, the first LED string includes two turned-on light-emitting unit 142[1] and light-emitting unit 142[2], the second LED string includes two turned-on light-emitting unit 142[3] and light-emitting unit 142[4], and the third LED string includes two turned-on light-emitting unit 142[5] and light-emitting unit 142[6]. The three LED strings are coupled between the positive output terminal O+ and the negative output terminal O−, and are coupled in parallel with each other.

In other words, by using the control module 160 to compare the driving voltage $V_D$ with the conduction voltage $V_F$ to output different control signals VC+ and different control signals VC−, the switch S[(n−1)_] and the switch S[(n)$_+$] of at least one group of adjacent light-emitting modules 140 can be turned on, Thus, a corresponding rectifying diode D[n] is reverse-biased. As a result, the rectifying diode D[n] is turned off, and the LED strings that are coupled in parallel with each other are formed.

For example, with reference to the conducting path 304 shown in FIG. 3C, the switch S[2_] of the second light-emitting module 140 and the switch S[3$_+$] of the third light-emitting module 140 are turned on. Under this circumstance, the anode of the rectifying diode D[3] is coupled to the negative output terminal O−, and the cathode of the rectifying diode D[3] is coupled to the positive output terminal O+. Thus, the rectifying diode D[3] is reverse-biased and turned off. Similarly, the rectifying diode D[5] is reverse-biased and turned off. As a result, the six light-emitting modules 140 can form the three LED strings that are coupled in parallel with each other.

In addition, as mentioned above, when the driving voltage $V_D$ is the same as the conduction voltage $V_F$, the six light-emitting modules 140 form the six LED strings that are coupled in parallel with each other. When the driving voltage $V_D$ is twice as much as the conduction voltage $V_F$, the six light-emitting modules 140 form the three LED strings that are coupled in parallel with each other. As far as the rectifier circuit 120 is concerned, its load, i.e., the six light-emitting modules 140, is instantly adjusted according to different driving voltage $V_D$. Thus, a const-power driving mechanism is achieved. In other words, the light-emitting modules 140 provided in this application can dynamically switch their internal connections, so as to be adapted to different driving voltages $V_D$. As a result, the light-emitting modules 140 are kept being lighted simultaneously.

In the embodiments illustrated in FIG. 3A-FIG. 3C, the light-emitting modules 140 have the same circuit architectures. The following paragraphs provide certain embodiments, in which the light-emitting modules 140 have different circuit architectures.

Figure 4A:
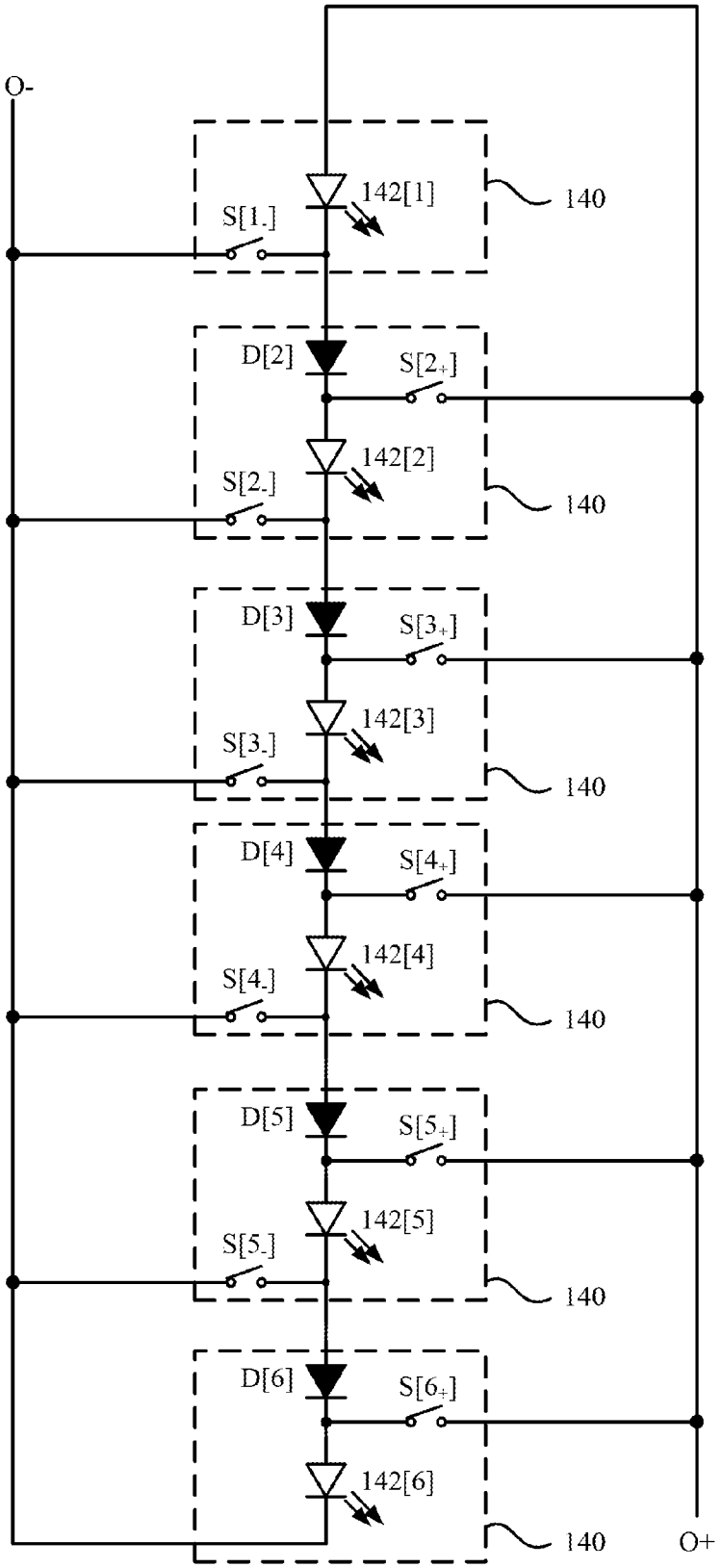
FIG. 4A is a schematic diagram of six light-emitting modules coupled in series according to other some embodiments of the present disclosure.

Reference is now made to FIG. 4A. FIG. 4A is a schematic diagram of six light-emitting modules coupled in series according to some other embodiments of the present disclosure. As shown in FIG. 4A, the first light-emitting module 140 includes the light-emitting unit 142[1] and the switch S[1_], and the six-th light-emitting module 140 includes the rectifying diode D6, the switch S[6$_+$], and the light-emitting unit 142[6]. Compared with the embodiments illustrated in FIG. 3A-FIG. 3C, the first light-emitting module 140 in FIG. 4A omits the rectifying diode D[1] and the switch S[1$_+$], and the six-th light-emitting module 140 omits the switch S[6_].

In other words, in some embodiments, the first terminal of the light-emitting unit 142[1] of the first light-emitting module 140 of the series-coupled light-emitting modules 140 is directly coupled to the positive output terminal O+, and the second terminal of the light-emitting unit 142[6] of the last light-emitting module 140 of the series-coupled light-emitting modules 140 is directly coupled to the negative output terminal O−. As a result, the fabrication cost and size of the illumination device 100 are further reduced.

Figure 4B:
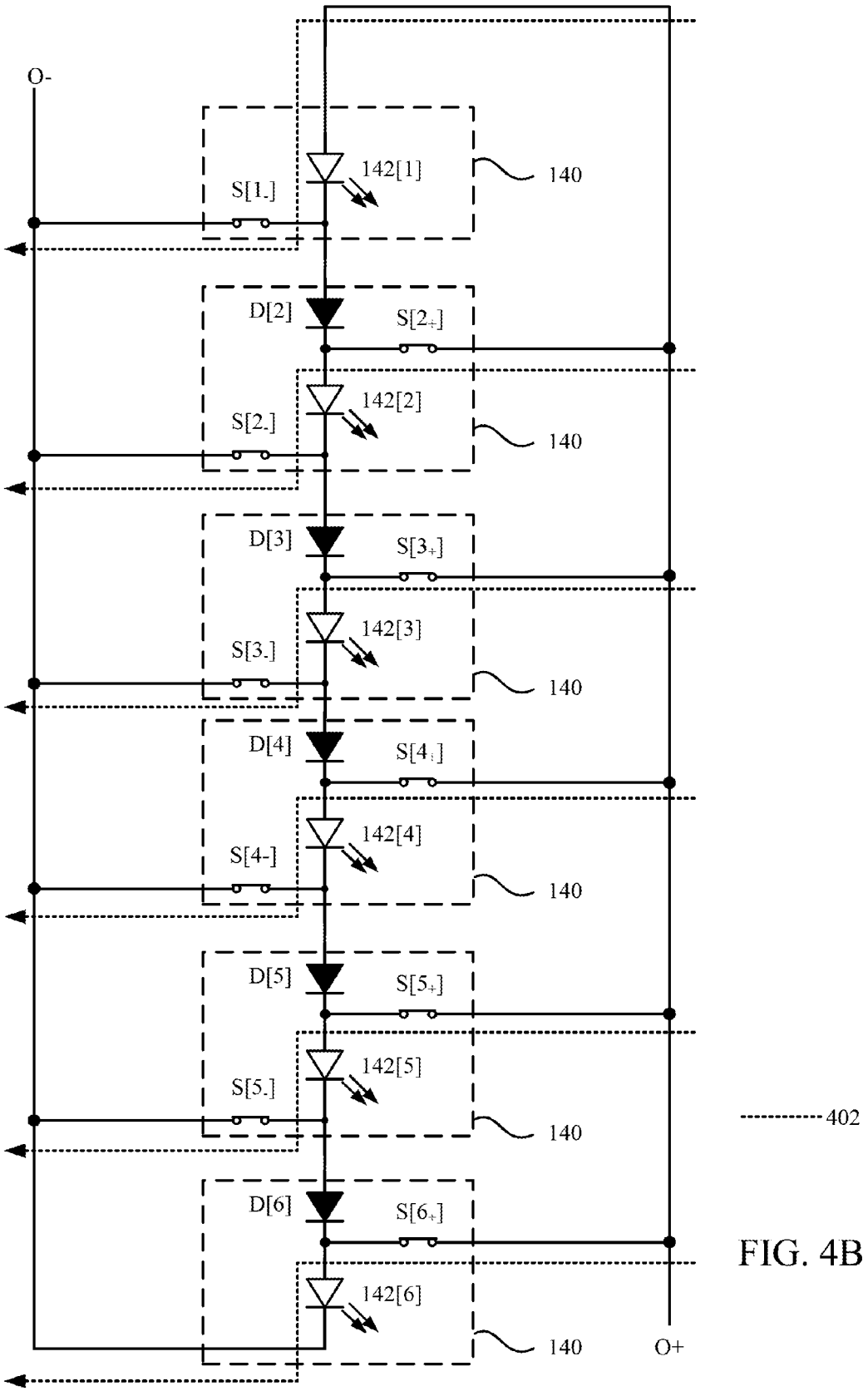
FIG. 4B is a schematic diagram illustrating a conducting status of the light-emitting modules in FIG. 4A according to some embodiments of the present disclosure.

Reference is now made to FIG. 4B. FIG. 4B is a schematic diagram illustrating a conducting status of the light-emitting modules in FIG. 4A according to some embodiments of the present disclosure. As shown in FIG. 4B, when the driving voltage $V_D$ is same as the conduction voltage $V_F$, the control module 160 outputs a plurality of control signals VC+ and the control signals VC− to turn on all of the switches S[2$_+$]-S[6$_+$] and the switches S[1_]-S[5_] (i.e., as illustrated with the conducting path 402). Under this circumstance, the connection between the six light-emitting modules 140 forms six LED strings that are coupled in parallel with each other. The number of the light-emitting units 142[*n*] in each LED string is one.

In greater detail, as shown in FIG. 4B, the first LED string includes a turn-on light-emitting unit 142[1], the second LED string includes a turn-on light-emitting unit 142[2], the third LED string includes a turned-on light-emitting unit 142[3], the fourth LED string includes a turned-on light-emitting unit 142[4], the fifth LED string includes a turned-on light-emitting unit 142[5], and the sixth LED string includes a turned-on light-emitting unit 142[6]. The six LED strings are coupled between the positive output terminal O+ and the negative output terminal O−, and are coupled in parallel with each other.

Figure 4C:
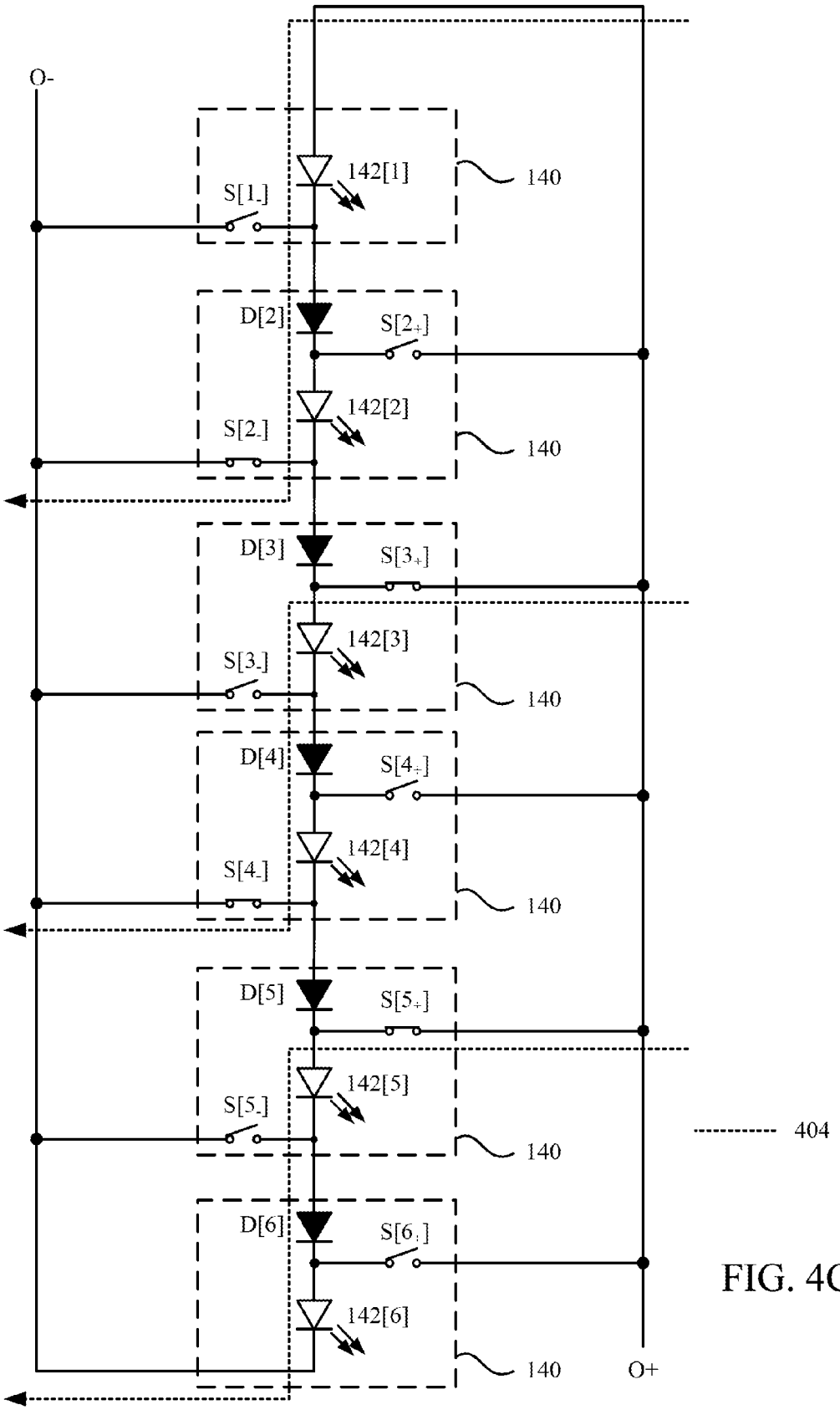
FIG. 4C is a schematic diagram illustrating a conducting status of the light-emitting modules in FIG. 4A according to another embodiments of the present disclosure.

Reference is now made to FIG. 4C. FIG. 4C is a schematic diagram illustrating a conducting status of the light-emitting modules in FIG. 4A according to some embodiments of the present disclosure. As shown in FIG. 4C, when the driving voltage $V_D$ is twice as much as the conduction voltage $V_F$, the control module 160 accordingly outputs the control signals VC+ and the control signals VC−, so as to turn on the switch S[2_], the switch S[3$_+$], the switch S[4_], and the switch S[5$_+$] (i.e., as illustrated with the conducting path 404). Under this circumstance, the connection mode of the six light-emitting modules 140 forms three LED strings that are coupled in parallel with each other, and the number of the light-emitting units 142[*n*] in each LED string is two.

In greater detail, as shown in FIG. 4C, the first LED string includes two turned-on light-emitting units 142[1] and 142[2], the second LED string includes two turned-on light-emitting units 142[3] 142[4], and the third LED string includes two turned-on light-emitting units 142[5] and 142[6]. The three LED strings are coupled between the positive output terminal O+ and the negative output terminal O−, and are coupled in parallel with each other.

The following paragraphs provide various embodiments related to the illumination device 100 to illustrate functions and applications thereof. The present disclosure is not limited to the following embodiments.

Figure 5:
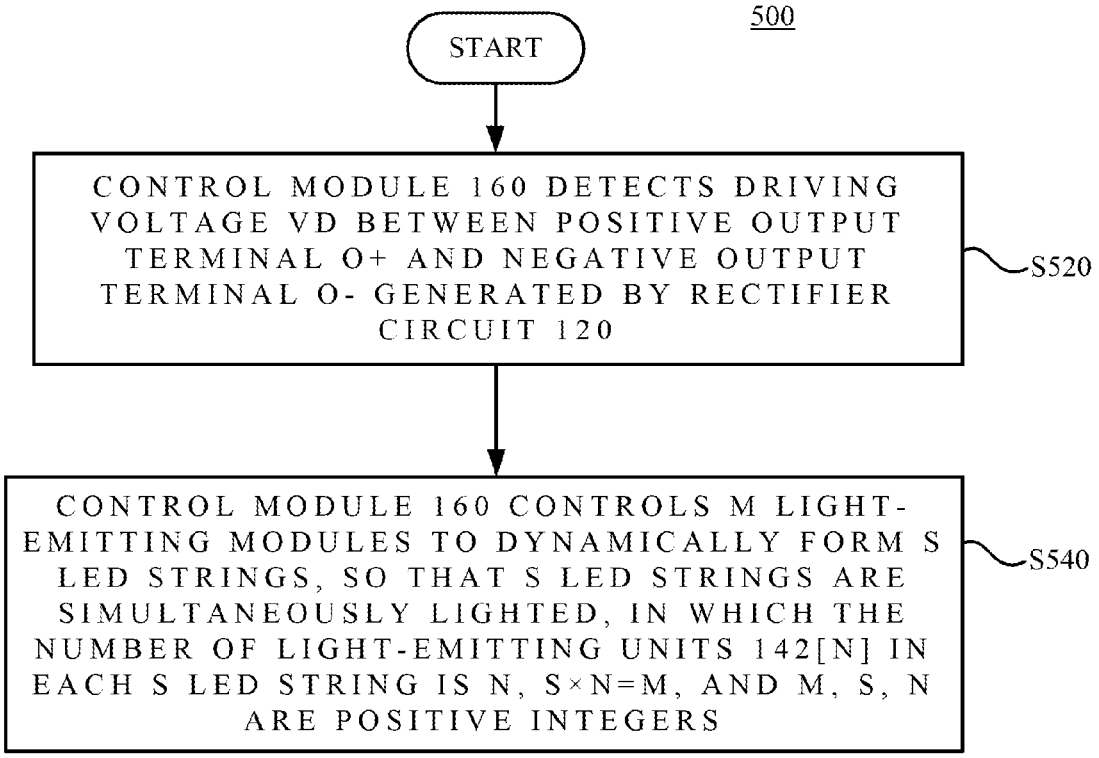
FIG. 5 is a flow chart of a control method according to some embodiments of the present disclosure.

Reference is now made to FIG. 5. FIG. 5 is a flow chart of a control method according to some embodiments of the present disclosure. The control method 500 is applicable to the illumination device 100, but is not limited thereto. For simplicity, reference is made to FIG. 1, FIG. 4A, and FIG. 5, the operations of the illumination device 100 are described with the control method 500. Moreover, for simplicity, the following paragraphs are illustrated with the illumination device 100 having M light-emitting modules 140.

As shown in FIG. 5, the control method 500 include step S520 and step 3540. In step S520, the control module 160 detects the driving voltage $V_D$ between the positive output terminal O+ and the negative output terminal O− generated by the rectifier circuit 120.

In step S540, the control module 160 controls the M light-emitting modules to dynamically form S LED strings, so that the S LED strings are simultaneously lighted, in which the number of the light-emitting units 142[*n*] in each S LED string is N, in which S×N=M, and M, S, N are positive integers.

In other words, S and N are factors of M. Thus, in some embodiments, the control module 160 can build a look up table according to the value of M, and to output the control signals VC+ and the control signals VC− according to the look up table, the driving voltage $V_D$, and the conduction voltage $V_F$, so as to control the light-emitting modules 140.

Taking FIG. 4A as an example, the illumination device 100 has six light-emitting modules 140 (i.e., M=6), and the control module 160 can output the corresponding control signals VC+ and control signals VC− according to the status of each switch with different driving voltages $V_D$ shown in a first look up table. The connection between the six light-emitting modules 140 is thus adjusted to form a different number of LED strings. In the first look up table, "ON" indicates that the corresponding switch is turned on, and the blank field indicates that the corresponding switch is turned off.

First Look Up Table.

| $V_D$ | S[1_] | S[2+] | S[2_] | S[3+] | S[3_] | S[4+] | S[4_] | S[5+] | S[5_] | S[6+] |
|---|---|---|---|---|---|---|---|---|---|---|
| 6 × $V_F$ | | | | | | | | | | |
| 5 × $V_F$ | | | | | ON | ON | | | | |
| 4 × $V_F$ | | | | | ON | ON | | | | |
| 3 × $V_F$ | | | | | ON | ON | | | | |
| 2 × $V_F$ | | | ON | ON | | | ON | ON | | |
| 1 × $V_F$ | ON | ON | ON | ON | ON | ON | ON | ON | ON | ON |
| 0 × $V_F$ | ON | ON | ON | ON | ON | ON | ON | ON | ON | ON |

For example, as shown in FIG. 4B, when the driving voltage $V_D$ is the same as the conduction voltage $V_F$, the control module 160 outputs the control signals VC+ and the control signals VC− according to the first look up table. Thus, the switches S[2+]-S[6+] and the switches S[1_]-S[5_] are turned on to form six LED strings that are coupled in parallel with each other (i.e., S=6), and the number of the light-emitting units 142[*n*] in each LED string is one (i.e., N=1). Alternatively, when the driving voltage $V_D$ is twice as much as the conduction voltage $V_F$, the control module 160 outputs the corresponding control signals VC+ and control signals VC− to turn on the switch S[2_], the switch S[3+], the switch S[4_], and the switch S[5+]. Thus, the three LED strings that are coupled in parallel with each other (i.e., S=3) are formed, in which the number of the light-emitting units 142[*n*] in each LED string is two (i.e., N=2).

Similarly, when the driving voltage $V_D$ is three times as much as the conduction voltage $V_F$, the control module 160 outputs the corresponding control signals VC+ and control signals VC− according to the first look up table, to turn on the switch S[3_] and the switch S[4+]. Thus, the two LED strings that are coupled in parallel with each other (i.e., S=2) are formed, in which the number of the light-emitting units 142[*n*] in each LED string is three (i.e., N=3).

In greater detail, in various embodiments, when the driving voltage $V_D$ is S times as much as the conduction voltage $V_F$, and S is a positive integer not equal to M, the switch S[$n_+$] and the switch S[(n−1)_] of a least one group of adjacent light-emitting modules 140 are turned on, so as to form S LED strings. For illustration, in this example, M=6, when the driving voltage $V_D$ is three times as much as the conduction voltage $V_F$, i.e., S=3, the switch S[3_] of the third light-emitting module 140 and the switch S[4+] of the fourth light-emitting module 140 are turned on, so as to form two LED strings that are coupled in parallel with each other.

By analogy, when the driving voltage $V_D$ is six as much as the conduction voltage $V_F$, the control module 160 outputs the corresponding control signals VC+ and control signals VC− to turn off all of the switches S[1_]-S[6,]. Thus, one LED string (i.e., S=1) is formed, in which the number of the light-emitting units 142[*n*] in the LED string is six (i.e., N=6). In other words, this LED string has six turn-on light-emitting units 142[*n*]-142[6].

Figure 6:
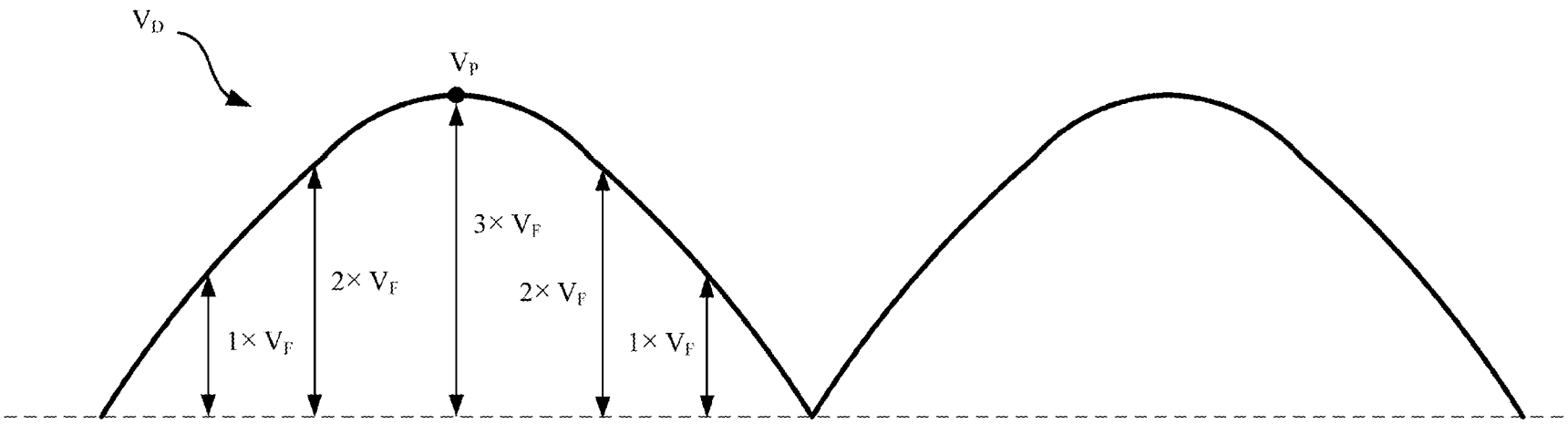
FIG. 6 is a waveform diagram of a driving voltage $V_D$ according to some embodiments of the present disclosure.

Reference is now made to FIG. 6. FIG. 6 is a waveform diagram of the driving voltage $V_D$ according to some embodiments of the present disclosure. The amplitude of the driving voltage $V_D$ changes from about 0 volts to the peak value $V_P$. In some embodiments, the peak value $V_P$ is configured to be three times as much as the conduction voltage $V_F$. As a result, the illumination device 100 shown in FIG. 1 may dynamically and continuously switch its internal connection with the change of the driving voltage $V_D$, and thus smooth-illumination effects are achieved.

Furthermore, in some embodiments, under certain circumstances, where the input power $V_{IN}$ is unstable, the amplitude of the fluctuation of the driving voltage $V_D$ may be larger. For example, the driving voltage $V_D$ may rise to Z times the magnitude of the conduction voltage $V_F$ in sudden, where M is greater than Z, and is not a multiple-integer of Z. Under this circumstance, the control module 160 determines a factor X closest to Z among the factors of M, and outputs the corresponding control signals VC+ and control signals VC− according to the factor X and the first look up table. Thus, X LED strings that are coupled in parallel with each other are formed, and the number of the light-emitting units 142[*n*] in each LED string is W, in which X is not greater than Z, and Z, X, and W are positive integers. As a result, the illumination device 100 can keep the light-emitting units 142[*n*] being lighted simultaneously under the circumstances where power is unstable.

For example, as shown in the first look up table, when the driving voltage $V_D$ is four times or five times as much as the conduction voltage $V_F$ (i.e., Z=4 or 5), the control module 160 outputs the corresponding control signals VC+ and control signals VC− with the arrangement corresponding to three times of the conduction voltage $V_F$ (i.e., X=3), so as to turn on the switch S[3_] and the switch S[4+]. Thus, two LED strings (i.e., S=3) that are coupled in parallel with each other are formed, and the number of the light-emitting unit 142[*n*] in each LED string is 3 (i.e., W=3). In other words, the first LED string includes three turned-on light-emitting units 142[1], 142[2], and 142[3], the second LED string includes three turned-on light-emitting units 142[4], 142[5], and 142[6], and these LED strings are coupled in parallel with each other.

Through the aforementioned embodiments, the illumination device 100 is applicable to the driving voltage $V_D$ having a wide fluctuation range, for example, the peak value $V_P$ varies from about 90 to about 270 voltages. Since the illumination device 100 can dynamically switch its internal connections so as to be lighted simultaneously, flickers can be effectively reduced without using energy storage elements, such as capacitors or inductors with large size (e.g., electrolytic capacitor). In addition, since the light-emitting modules 140 can be lighted simultaneously with different driving voltages $V_D$, the usage of the light-emitting 142[*n*] of the illumination device 100 is increased.

Moreover, when the illumination device 100 is applied with TRIAC dimmers, as all of the light-emitting modules 140 are lighted simultaneously, the illumination device 100 can achieve a constant power with different conduction angles. As a result, the relationship between the periodic average output light power and the conduction angle can be more linear, and thus the shimmer is reduced. Further, as the light-emitting modules 140 are lighted simultaneously, uniform-dimming effects can be achieved.

Reference is now made to FIG. 7. FIG. 7 is a second look up table illustrating the status of each switch in twelve light-emitting modules according to some embodiments of the present disclosure. In some embodiments, the illumination device 100 is expanded to have twelve illumination devices 140. In this example, the control module 160 outputs the corresponding control signals VC+ and control signals VC− according to the status of each switch under different driving voltages $V_D$ shown in FIG. 7, so as to switch the series and/or parallel connections between each light-emitting module 140. Thus, the different number of the LED strings is formed, and the operations of being lighted simultaneously are achieved. Related operations are similar with the aforementioned embodiments illustrating with the first look up table, and thus the repetitious descriptions are not given here.

The number of the light-emitting modules 140 and the number of LEDs in the light-emitting unit 142[*n*] are given for illustrative purpose only, but the present disclosure is not limited thereto. The light-emitting module 140 provided in the present disclosure is able to be implemented with a modular design. As a result, those skilled in the art may use different numbers of the light-emitting modules 140 according to actual applications.

Through such an arrangement, when the input power $V_{IN}$ varies, the control module 160 can instantly adjust the connection between the M light-emitting modules 140, so as to form S LED strings that are lighted simultaneously. For example, when the driving voltage $V_D$ is M times of the conduction voltage $V_F$, the M light-emitting modules 140 form one LED string, and this LED string includes series-coupled light-emitting units 142[*n*]. With variation of the input power $V_{IN}$, the number of the LED strings formed by the M light-emitting modules 140 and the number of light-emitting units 142[*n*] in each LED strings are dynamically adjusted, so that the M light-emitting modules 140 are kept being lighted simultaneously with different driving voltages $V_D$.

Further, since the characteristic of modular design of the light-emitting modules in this application, the illumination device 100 can be widely applied to various power systems. For example, when the voltage of the power system is higher, the number of the light-emitting modules 140 in the illumination device 100 can be accordingly increased. Otherwise, when the voltage of the power system is lower, the number of the light-emitting modules 140 in the illumination device 100 can be accordingly reduced.

Reference is now made to FIG. 8. FIG. 8 is a third look up table illustrating the status of each switch in twelve light-emitting modules according to some embodiments of the present disclosure. In some other embodiments, the control module 160 outputs the corresponding control signals VC+ and control signals VC− according to the status of each switch under different driving voltages $V_D$ shown in the third look up table of FIG. 8, so as to switch the series and/or parallel connections between each light-emitting module 140. Compared with the second look up table illustrated in FIG. 7, in this embodiment, when the driving voltage $V_D$ is five times as much as the conduction voltage $V_F$, the control module 160 only turns on the switches S[2$_+$], S[6_], S[7$_+$], and S[11_], so as to form two LED strings that are coupled in parallel with each other, in which the light-emitting units in the first light-emitting module 140 and the twelfth light-emitting module 140 are not lighted.

In other words, in some embodiments, when the driving voltage $V_D$ is Z times as much as the conduction voltage $V_F$ and M is greater than Z, and is not a multiple-integer of Z, an user is able to set the corresponding look up table to assign the configuration of the M light-emitting modules 140. As a result, the lighting operations of the M light-emitting modules 140 can have a higher flexibility.

Figure 9A:
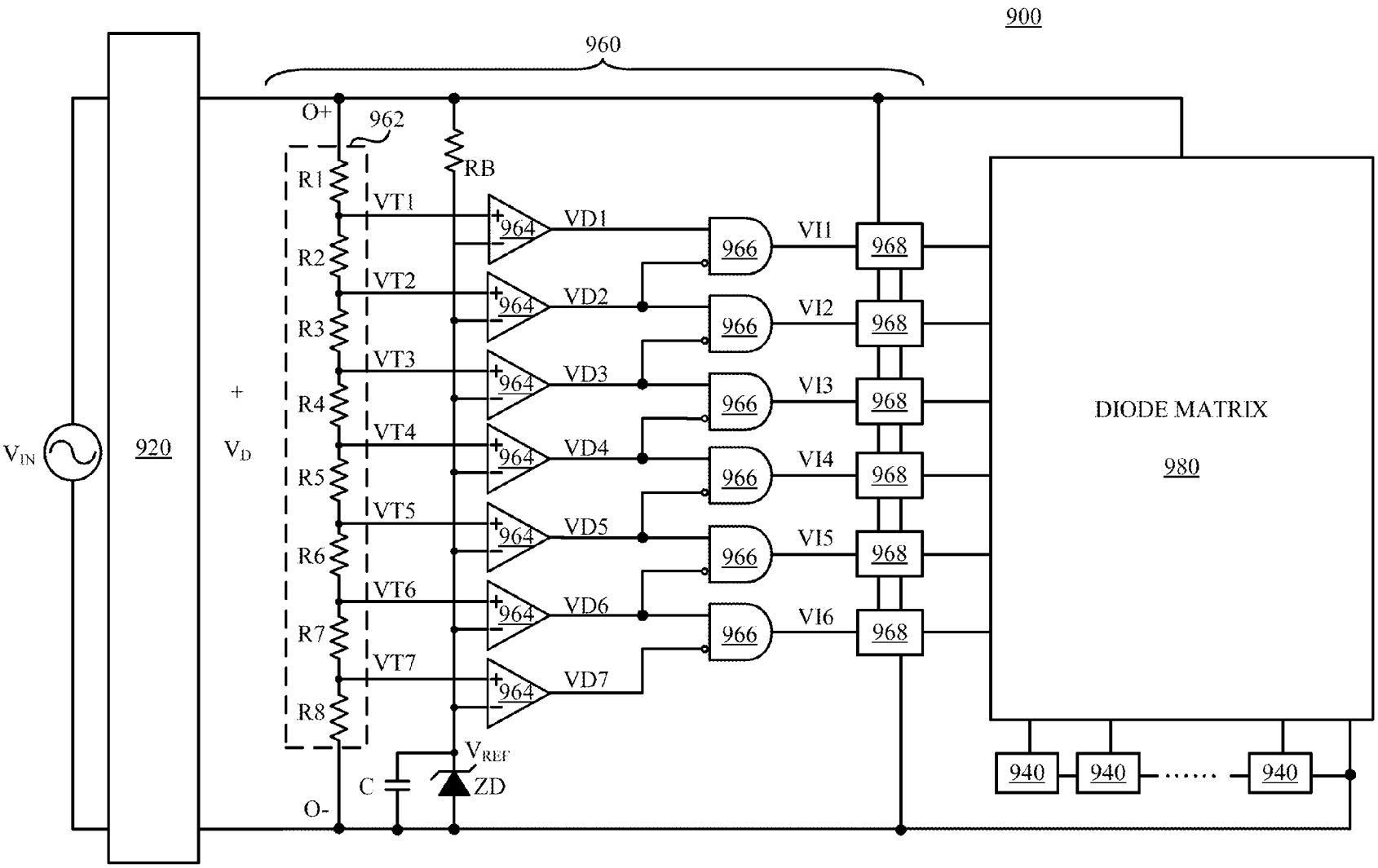
FIG. 9A is a schematic diagram of an illumination device according to some embodiments of the present disclosure.

Reference is now made to FIG. 9A. FIG. 9A is a schematic diagram of an illumination device according to some embodiments of the present disclosure. As shown in FIG. 9A, the illumination device 900 includes a rectifier circuit 920, M light-emitting modules 940, a control module 960, and a diode matrix 980.

The rectifier circuit 920 has a positive output terminal O+ and a negative output terminal O−, and is configured to receive an input power $V_{IN}$, to generate a driving voltage $V_D$ between the positive output terminal O+ and the negative output terminal O−. The arrangements of the rectifier circuit 920 is similar with the rectifier circuit 120, as illustrated in the embodiments above, and thus the repetitious descriptions are not given here.

Figure 9B:
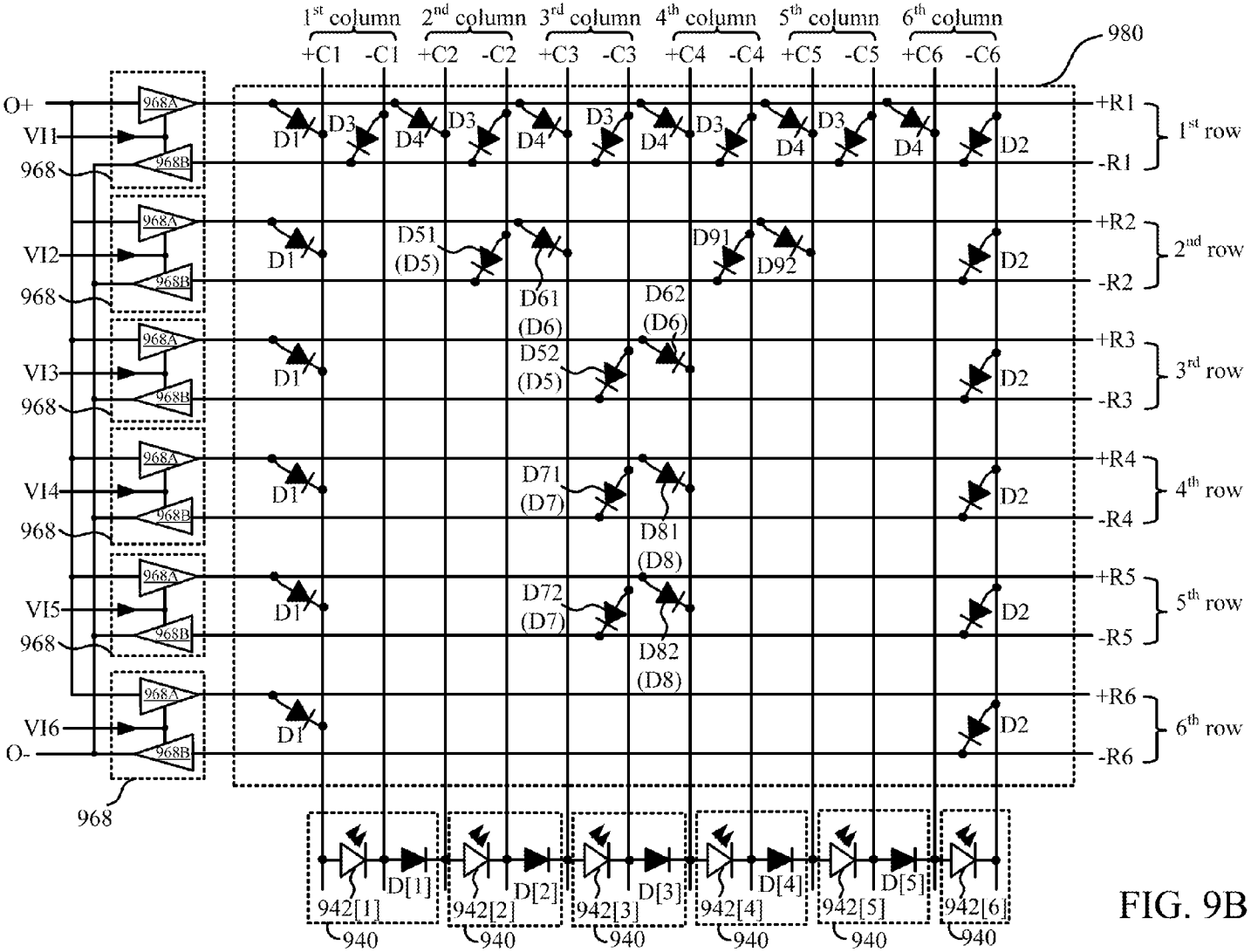
FIG. 9B is a schematic diagram illustrating the connection between the driving unit, the diode matrix, and the light-emitting modules in FIG. 9A, according to some embodiments of the present disclosure.

The M light-emitting modules 940 are coupled in series to form a LED circuit, and are coupled between the positive output terminal O+ and the negative output terminal O−. The M light-emitting module 140 includes at least one light-emitting unit, for example, as illustrated in FIG. 9B below, the six light-emitting modules 940 include light-emitting units 942[1]-942[6], respectively, and the light-emitting units can be driven by the driving voltage $V_D$ to emit light. As described above, each of the light-emitting units includes at least one LED.

The control module 960 is coupled between the positive output terminal O+ and the negative output terminal O− to detect the driving voltage $V_D$. The control module 960 is coupled between the rectifier circuit 920 and the M light-emitting modules 940. As a result, the control module 960 can turn on at least one diode of the diode matrix 980 according to the driving voltage $V_D$ and the conduction voltage $V_F$ of the light-emitting unit 942[*n*], in order to control the M light-emitting modules 940 to dynamically form S light-emitting diode strings coupled in parallel with each other. A number of the light-emitting units in each of the S light-emitting diode strings is N, and S×N=M, where M, S, N are positive integers.

In some embodiments, the control module 960 includes a voltage dividing circuit 962, comparators 964, logic gates 966, and driving units 968. The voltage dividing circuit 962 includes resistors R1-R8. The resistors R1-R8 are sequentially coupled between the positive output terminal O+ and the negative output terminal O− in series, so as to generate testing voltages VT1-VT7 by dividing the driving voltage $V_D$. For example, by choosing the resistance values of the resistors R1-R8, the testing voltages VT1-VT7 are able to be sequentially generated. The testing voltage VT1-VT7 can be the same as the driving voltage $V_D$, one-half of the driving voltage $V_D$, one third of the driving voltage $V_D$, . . . , and one seventh of the driving voltage $V_D$, respectively. The arrangements for the resistor values of the resistors R1-R8 are given for illustrative purposes only, and the present disclosure are not limited in this regard. Various arrangements for the voltage dividing circuit that is able to perform the same functions are within the contemplated scope of the present disclosure.

The comparators 964 compare the testing voltages VT1-VT7 with a reference voltage $V_{REF}$, respectively, to output detecting signals VD1-VD7. In various embodiments, a predetermined ratio is present between the reference voltage $V_{REF}$ and the conduction voltage $V_F$. For example, in some embodiments, the reference voltage $V_{REF}$ is configured to be the same as the conduction voltage $V_F$. Accordingly, the comparators 964 can compare the testing voltages VT1-VT7 with the reference voltage $V_{REF}$, so as to determine the relation between the driving voltage $V_D$ and the conduction voltage $V_F$. Alternatively, in some other embodiments, the reference voltage $V_{REF}$ is configured to be one-twelve of the conduction voltage $V_F$. Under this circumstance, the resistance values of the resistors R1-R8 are determined to generate the testing voltages VT1-VT7, in which the testing voltages VT1-VT7 are (1×1/12) times as much as the driving voltage $V_D$, (1/2×1/12) times as much as the driving voltage $V_D$, (1/3×1/12) times as much as the driving voltage $V_D$, . . . , and, (1/7×1/12) times as much as the driving voltage $V_D$.

The values of the predetermined ratio are given for illustrative purposes only, and the present disclosure is not limited in this regard. Person of skilled in the art is able to adjust the predetermined ratio according to various system parameters, for example, including the conduction voltage $V_F$, the input range of the comparator 964, etc.

In some embodiments, the reference voltage $V_{REF}$ is directly inputted by external circuits. Alternatively, in some other embodiments, the reference voltage $V_{REF}$ can be indirectly generated from the driving voltage $V_D$. For illustration, as shown in FIG. 9A, the illumination device 900 further includes a reference voltage generation circuit. The reference voltage generation circuit includes a resistor RB, a zener diode ZD, and a capacitor C. The zener diode ZD and the capacitor C are coupled in parallel with each other, and are coupled between the positive output terminal O+ and the negative output terminal O− via the resistor RB. With such arrangement, when receiving the driving voltage $V_D$, the zener diode ZD can accordingly output the reference voltage $V_{REF}$. The arrangements for generating the reference voltage $V_{REF}$ are given for illustrative purposes only, and the present disclosure is not limited herein. Various types of the reference voltage generation circuit are also within the contemplated scope of the present disclosure.

With continued reference to FIG. 9A, the logic gates 966 are disposed corresponding to the comparator 964, so as to receive two of the detecting signal VD1-VD7, respectively. Accordingly, the logic gates 966 outputs active signals VI1-VI6. For illustration, the first logic gate 966 is configured to receive the detecting signals VD1 and VD2, and accordingly output the active signal VI1. The second logic gate 966 is configured to receive the detecting signals VD2 and VD3, and accordingly output the active signal VI2. On the analogy of this manner, the logic gates 966 can accordingly output the active signals VI1-VI6.

In some embodiments, the logic gate 966 can be an AND gate having an inverse input terminal. As a result, only one of the active signals VI1-VI6 is at a high level. For example, when the testing voltage VT1 is same as the reference voltage $V_{REF}$, i.e., the testing voltages VT2-VT8 are lower than the reference voltage $V_{REF}$, the detecting signal VD1 is at the high level, and the detecting signals VD2-VD7 are at a low level. Thus, the first logic gate 966 accordingly outputs the active signal VI1 being at the high level, and other logic gates 966 output the active signals VI2-VI6 being at the low level. In other words, with such arrangement, the relation between the current driving voltage $V_D$ and the conduction voltage $V_F$ can be determined according to the low level of the active signals VI1-VI6.

The driving units 968 are disposed corresponding to the logic gates 966, so as to be enabled by a corresponding one of the active signals VI1-VI6. The driving units 968 are coupled to the diode matrix 980, so as to transmit the driving voltage $V_D$ to the diode matrix 980 when being enabled. Accordingly, at least one of the diode of the diode matrix 980 is lighted.

Reference is now made to FIG. 9B. FIG. 9B is a schematic diagram illustrating the connection between the driving unit, the diode matrix, and the light-emitting modules in FIG. 9A, according to some embodiments of the present disclosure.

As shown in FIG. 9B, the diode matrix 980 includes M columns and rows. Each column includes a corresponding column electrode line +Cy and a corresponding column electrode line −Cy, in which y=1, 2, 3, . . . , and M (in this embodiment, M=6), and each row includes a corresponding row electrode line +Ry and a row electrode line −Ry. In this embodiment, each driving unit 968 includes a driver 968A and a driver 968B. The driver 968A is coupled between a corresponding row electrode line +Ry and the positive output terminal O+, so as to transmit the driving voltage $V_D$ to the corresponding row electrode line +Ry when being enabled by the corresponding one of the active signals VI1-VI6. The driver 968B is coupled between a corresponding row electrode line −Ry and the negative output terminal O−, and is enabled according to the corresponding one of the active signals VI1-VI6.

In this embodiment, the light-emitting unit 942[*n*] of the light-emitting module 940 has a first terminal and a second terminal. An n-th one of the M light-emitting module 940 includes a rectifying diode D[n], in which n is a positive integer less than M. The arrangement of the light-emitting unit 942[*n*] is similar with the light-emitting unit 142[*n*] described above, and thus the repetitious descriptions are not given here. In addition, for simplicity, the following embodiments are illustrated with the light-emitting unit 942[*n*] having a single one LED. A first terminal of the light-emitting unit 942[*n*] of the n-th light-emitting module 940 is coupled to the column electrode line +Cn of the n-th column, and a second terminal of the light-emitting unit 942[*n*] is coupled to the column electrode line −Cn of the n-th column. An anode of the rectifying diode D[n] of the n-th light-emitting module 940 is coupled to the column electrode −Cn of the n-th column, and a cathode of the rectifying diode D[n] is coupled to the column electrode line +C(n+1) of the (n+1)-th column.

For example, in this embodiment, n=1, 2, 3, 4, and 5. For illustration with n=2, as shown in FIG. 9B, a first terminal of the light-emitting unit 942[2] of the second light-emitting module 940 is coupled to the column electrode line +C2 of the second column, and a second terminal of the light-emitting unit 942[2] is coupled to the column electrode line −C2 of the second column. An anode of the rectifying diode D[2] of the second light-emitting module 940 is coupled to the column electrode line −C2 of the second column, and a cathode of the rectifying diode D[2] is coupled to the column electrode line +C3 of the third column.

In addition, in various embodiments, a first terminal of the light-emitting unit 942[6] of the M-th light-emitting module 940 (in this example, M=6) is coupled to the column electrode line +C6 of the sixth column, and a second terminal of the light-emitting unit 942[6] is coupled to the column electrode line −C6 of the sixth column.

In various embodiments, the diode matrix 980 further includes diodes D1-D8, a diode D91, and a diode D92. Anodes of the diodes D1 are coupled to the row electrode lines +R1~+R6 of the rows, respectively, and cathodes of the diodes D1 are coupled to the column electrode line +C1 of the first column. Anodes of the diodes D2 are coupled to the column electrode lines −C6 of the sixth column, and cathodes of the diodes D2 are coupled to the row electrode line −R1~−R6 of the rows. Anodes of the diodes D3 are coupled to the column electrode lines −C1~−C5 of the first to the fifth columns, respectively, and cathodes of the diode D3 are coupled to the row electrode line −R1 of the first row. Anodes of the diodes D4 are coupled to the row electrode line +R1 of the first row, and cathodes of the diodes D4 are coupled to the column electrode lines +C2~+C6, respectively.

In some embodiments, an anode of one of the diodes D5 is coupled to a column electrode line −CR of a R-th column of the M columns, and its cathode is coupled to the row electrode line −RR of a R-th row, in which R is a factor of M. and R is not equal to 1 or M. In some embodiments, an anode of the diodes D6 is coupled to the row electrode line +RR of the R-th row, and a cathode thereof is coupled to the column electrode line +C(R+1) of a (R+1)-th column.

For illustration, as shown in FIG. 9B, the diodes D5 include a diode D51 and a diode D52, and the diodes D6 include a diode D61 and a diode D62. An anode of the diode D51 is coupled to the column electrode line −C2 of the second column, and a cathode of the diode D51 is coupled to the row electrode line −R2 of the second row. An anode of the diode D52 is coupled to the column electrode line −C3 of the third column, and a cathode of the diode D52 is coupled to the row electrode line −R3 of the third row. An anode of the diode D61 is coupled to the row electrode line +R2 of the second row, and a cathode of the diode D61 is coupled to the column electrode line +C3 of the third column. An anode of the diode D62 is coupled to the roe electrode line +R3 of the third row, and a cathode of the diode D62 is coupled to the column electrode line +C4 of the fourth column.

In some embodiments, an anode of one of the diodes D7 is coupled to a column electrode line −CT of a T-th column, and a cathode thereof is coupled to the row electrode line −Ry of a corresponding row, in which T is a positive integer, and is an one Y-th of M, where Y is a positive integer greater than or equal to 2. An anode of one of the diodes D8 is coupled to the row electrode +Ry of a corresponding row, and a cathode thereof is coupled to the column electrode line +CT of the (T+1)-th column.

For illustration, as shown in FIG. 9B, the diodes D7 include a diode D71 and a diode D72, and the diodes D8 include a diode D81 and a diode D92. An anode of the diode D71 is coupled to the column electrode line −C3 of the third column, and a cathode of the diode D71 is coupled to the row electrode line −R4 of the fourth row. An anode of the diode D72 is coupled to the column electrode line −C3 of the third column, and a cathode of the diode D72 is coupled to the row electrode line −R5 of the fifth row. An anode of the diode D81 is coupled to the row electrode line +R4 of the fourth row, and a cathode of the diode D81 is coupled to the column electrode line +C4 of the fourth column. An anode of the diode D82 is coupled to the row electrode line +R5 of the fifth row, and a cathode of the diode D82 is coupled to the column electrode line +C4 of the fourth column.

Furthermore, an anode of the diode D91 is coupled to the column electrode line −C4 of the fourth column, and a cathode of the diode D91 is coupled to the row electrode line −R2 of the second row. An anode of the diode D92 is coupled to the row electrode line +R2 of the second row, and a cathode of the diode D92 is coupled to the column electrode line +C5 of the fifth column.

With the arrangements illustrated above, the control module 960 is able to enable a corresponding driving unit 968 according to the driving voltage $V_D$ and the conduction voltage $V_F$. Accordingly, the diodes on a corresponding row of the diode matrix 980 are driven by the driving unit 968, so as to control the M light-emitting modules 940 dynamically form S light-emitting diode strings that are coupled in parallel with each other.

For example, when the driving voltage $V_D$ is the same as the conduction voltage $V_F$, the detecting signal VD1 is at a high level, and the others detecting signal VD2-VD7 are at a low level. Accordingly, the logic gates 966 output the active signal VI1 being at the high level and the active signals VI2-VI6 being at the low level, respectively. The first driving unit 968 is enabled to transmit the driving voltage $V_D$ by the corresponding driver 968A to the row electrode line +R1 of the first row, and to couple the row electrode line +R1 to the negative output terminal O− by the corresponding driver 968B. In other words, the diodes D1, D2, D3, and D4 of the first row of the diode matrix 980 are turned on. Thus, the light-emitting modules 940 form six LED strings and are lighted in the same time, in which the number of the light-emitting units 942[*n*] in each LED string is one.

On the analogy of this, when the driving voltage $V_D$ is twice as much as the conduction voltage $V_F$, the second driving unit 968 is enabled. Accordingly, the diodes D1, D51, D61, D91, D92, and D2 of the second row of the diode matrix 980 are turned on. Thus, the light-emitting modules 940 form three LED strings that are coupled in parallel with each other, in which the number of the light-emitting units 942[*n*] in each LED string is two.

Similarly, when the driving voltage $V_D$ is three times as much as the conduction voltage $V_F$, the third driving unit 968 is enabled, the diodes D1, D52, D62, and D2 of the third row of the diode matrix 980 are turned on, such that the six light-emitting modules 940 form two LED strings that are coupled in parallel with each other, and the number of the light-emitting units 942[*n*] in each LED string is three.

In some embodiments, when the driving voltage $V_D$ is Z times of the conduction voltage $V_F$, where M is greater than Z, and is not a multiple-integer of Z, at least one of the driving units 968 is enabled to turn on the diodes on a corresponding row of the diode matrix 980. As a result, the M light-emitting modules 940 form X LED strings that are coupled in parallel with each other, and the number of the light-emitting units 942[*n*] in each LED string is W, in which X is not greater than Z, and Z, X, and W are positive integers.

For illustration, in this embodiment, when the driving voltage $V_D$ is four times or five times as much as the conduction voltage $V_F$, the fourth driving unit 968 or the fifth driving unit 968 is enable to turn on the diodes D1, D71, D81, and D2 on the fourth row, or the diodes D1, D72, D82, and D2 on the fifth row of the diode matrix 980. As a result, the six light-emitting modules 940 form two LED strings that are coupled in parallel with each other, and the number of the light-emitting units 942[*n*] in each LED string is three.

Alternatively, when the driving voltage $V_D$ is six times as much as the conduction voltage $V_F$, the sixth driving unit 968 is enable to turn on the diodes on the sixth row of the diode matrix 980. Accordingly, the six light-emitting modules 940 form one LED string, and the number of the light-emitting units 942[*n*] in the LED string is six.

Moreover, in some embodiments, the arrangement of the diode matrix 980 in FIG. 9B is similar with the statues of each switch of the first look up table. In other words, with the different number of the light-emitting module 940, the arrangement of the diode matrix 980 can refer to the configurations of the different look up table, as described above. Previous embodiments are illustrated with the first look up table for illustrative purposes only, and the present disclosure is not limited thereto. For example, in different embodiments, the arrangement of the diode matrix 980 can be set with reference to the second look up table in FIG. 7 or the third look up table in FIG. 8.

In the illumination device 100 in FIG. 1, the control module 160 provides multiple control signals VC+ and VC−. In some further embodiments, the control module 160 includes multiple groups of drivers (not shown), and the multiple groups of drivers are required to output the control signals VC+ and VC− in the same time. With the increment of the number of the light-emitting module 140, the number of the drivers is increased. As a result, the power consumption of the illumination device 100 may be increased. Compared with the illumination device 100, in the illumination device 900, only one of the driving units 968 is enabled during the lighting operation.

Furthermore, compared with the light-emitting module 140, the light-emitting module 940 does not include additional switches $S[n_+]$ and $S[n_-]$. In the embodiments, with the arrangement of the diode matrix 980, the light-emitting modules 940 can dynamically switch the internal connection thereof. As a result, compared with the illumination device 100, the cost on the circuit of the illumination device 900 can be further reduced.

In summary, the illumination device, the circuit of the light-emitting module and the control method thereof provided in the present disclosure are applicable to the driving voltage with wide range, and the connections between the LEDs in the illumination device can be dynamically adjusted to achieve the operations of being lighted simultaneously. Further, the circuits provided in this present disclosure can be widely applied to the dimming circuits with linear-driving.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An illumination device, comprising:

a rectifier circuit having a positive output terminal and an negative output terminal, the rectifier circuit being configured to generate a driving voltage between the positive output terminal and the negative output terminal according to an input power;

M light-emitting modules coupled between the positive output terminal and the negative output terminal, wherein each of the M light-emitting modules has a conduction voltage, and comprises a light-emitting unit that comprises at least one light-emitting diode; and a control module coupled between the rectifier circuit and the M light-emitting modules, and configured to control the M light-emitting modules to dynamically form a plurality of light-emitting diode strings coupled in parallel with each other, wherein a number of the light-emitting units in each of the light-emitting diode strings is N, and a number of the light-emitting diode strings is S, and wherein when the driving voltage is changed from one time as much as the conduction voltage to (Q+q) times as much as the conduction voltage, the N is changed from one to Q and the S is changed from M to M/Q with the change of the driving voltage, where S×N=M, and M, S, N, Q are positive integers, and $0<q<1$, Q is greater than or equal to 3.

2. The illumination device of claim 1, wherein the M light-emitting modules are coupled in series, each of the light-emitting units comprises a first terminal and a second terminal, and an n-th light-emitting module of the M light-emitting modules further comprises:

a first rectifying diode, wherein a cathode of the first rectifying diode is coupled to the first terminal of the light-emitting unit of the n-th light-emitting module;

a first switch coupled between the positive output terminal and the cathode of the first rectifying diode, and configured to be selectively turned on according to an n-th one of a plurality of first control signals; and a second switch coupled between the negative output terminal and the second terminal of the light-emitting unit of the n-th light-emitting module, and configured to be selectively turned on according an n-th one of a plurality of second control signals, wherein an anode of the first rectifying diode is coupled to the second terminal of the light-emitting unit of a (n−1)-th light-emitting module of the M light-emitting modules, and the control module generates the first control signals and the second control signals according to the driving voltage and the conduction voltage, wherein n is positive integer greater than 1 and smaller than M.

3. The illumination device of claim 2, wherein a first light-emitting module of the M light-emitting modules further comprises:

a third switch coupled between the negative output terminal and the second terminal of the light-emitting unit of the first light-emitting module, and configured to be selectively turned on according to a first one of the second control signals, wherein the first terminal of the light-emitting unit of the first light-emitting module is coupled to the positive output terminal, and the second terminal of the light-emitting unit of the first light-emitting module is coupled to the anode of the first rectifying diode of a second light-emitting module of the M light-emitting modules.

4. The illumination device of claim 3, wherein a M-th light-emitting modules of the M light-emitting modules comprises:

a second rectifying diode, wherein a cathode of the second rectifying diode is coupled to the first terminal of the light-emitting unit of the M-th light-emitting module, and an anode of the second rectifying diode is coupled to the second terminal of the light-emitting unit of a (M−1)-th light-emitting module of the M light-emitting modules; and a fourth switch coupled between the positive output terminal and the cathode of the second rectifying diode, and configured to be selectively turned on according to a M-th one of the first control signals, wherein the second terminal of the light-emitting unit of the M-th light-emitting module is coupled to the negative output terminal.

5. The illumination device of claim 4, wherein when the driving voltage is same as the conduction voltage, the third switch, and the fourth switch and the first switch and the second switch of the n-th light-emitting module are turned on, such that the light-emitting units of the M light-emitting modules are coupled in series between the positive output terminal and the negative output terminal to form M light-emitting diode strings coupled in parallel with each other, wherein the number of the light-emitting unit in the M light-emitting strings is 1, and S=M, and N=1.

6. The illumination device of claim 4, wherein when the driving voltage is M times as much as the conduction voltage, and the third switch, the fourth switch, and the first switch and the second switch of the n-th light-emitting module are turned off, such that each the light-emitting unit of the M light-emitting modules is coupled in series between the positive output terminal and the negative output terminal to form a light-emitting diode string, wherein the number of the light-emitting unit in the light-emitting string is M, and S=1, and N=M.

7. The illumination device of claim 2, wherein a first light-emitting module of the M light-emitting modules, a M-th light-emitting module of the M light-emitting modules, and the n-th light-emitting module have the same circuit architecture, wherein the first switch of the first light-emitting module is configured to be turned on, and the second switch of the M-th light-emitting module is configured to be turned on.

8. The illumination device of claim 7, wherein when the driving voltage is the same as the conduction voltage, the first switch and the second switch of each of the M light-emitting modules are turned on, such that the light-emitting units of the M light-emitting modules are coupled in series between the positive output terminal and the negative output terminal to form M light-emitting diode string coupled in parallel with each other, wherein the number of the light-emitting unit in the M light-emitting strings is 1, and S=M, and N=1.

9. The illumination device of claim 7, wherein when the driving voltage is M times as much as the conduction voltage, and the first switch and the second switch of the n-th light-emitting module, the second switch of the first light-emitting module, and the first switch of the M-th light-emitting module are turned off, such that the light-emitting units of the M light-emitting modules are coupled in series between the positive output terminal and the negative output terminal to form a light-emitting diode string, wherein the number of the light-emitting unit in the light-emitting string is M, and S=1, and N=M.

10. The illumination device of claim 2, wherein when the driving voltage is S times as much as the conduction voltage, and the first switch of the n-th light-emitting module is turned on, and the second switch of the (n−1)-th light-emitting module is turned on, so as to form the S diode strings, wherein S is a positive integer but not equal to M.

11. The illumination device of claim 2, wherein when the driving voltage is Z times as much as the conduction voltage, M is greater than Z and is not an integral multiple of Z, the first switch of the n-th light-emitting module is turned on, and the second switch of the (n−1)-th light-emitting module is turned on, so as to form X diode strings coupled in parallel with each other, wherein the number of the light-emitting units in each of the X diode strings is W, where X and W are positive integers, and X is not greater than Z, and X is a first factor closest to Z among factors of M and X×W=M.

12. The illumination device of claim 2, wherein the control module further comprises a look up table, and the control module generates the corresponding first control signals and the corresponding second control signals according to the look up table, the driving voltage, and the conduction voltage.

13. A light-emitting diode circuit comprising a control module and M light-emitting modules that are coupled in series and are between a positive output terminal and a negative output terminal of a rectifier circuit which generate a driving voltage, wherein each of the M light-emitting modules comprising a light-emitting unit with a conduction voltage, the light-emitting unit having a first terminal and a second terminal, an n-th light-emitting module of the M light-emitting modules comprising:

a first rectifying diode, wherein a cathode of the first rectifying diode is coupled to the first terminal of the light-emitting unit of the n-th light-emitting module;

a first switch coupled between the positive output terminal and the cathode of the first rectifying diode, and configured to be selectively turned on according to an n-th one of a plurality of first control signals; and a second switch coupled between the negative output terminal and the second terminal of the light-emitting unit of the n-th light-emitting module, and configured to be selectively turned on according to an n-th one of a plurality of second control signals, wherein n is a positive integer greater than 1 and smaller than M, wherein the control module is configured to control the M light-emitting modules to dynamically form a plurality of light-emitting diode strings coupled in parallel with each other, and a number of the light-emitting units in each of the light-emitting diode strings is N, and a number of the light-emitting diode strings is S, and wherein when the driving voltage is changed from one time as much as the conduction voltage to (Q+q) times as much as the conduction voltage, the N is changed from one to Q and the S is changed from M to M/Q with the change of the driving voltage, where S×N=M, and M, S, N, Q are positive integers, and 0<q<1, Q is greater than or equal to 3.

14. The light-emitting diode circuit of claim 13, wherein a first light-emitting module of the M light-emitting modules further comprises:

a third switch coupled between the negative output terminal and the second terminal of the light-emitting unit of the first light-emitting module, and configured to be selectively turned on according to a first one of the second control signals, wherein the first terminal of the light-emitting unit of the first light-emitting module is coupled to the positive output terminal, and the second terminal of the light-emitting unit of the first light-emitting module is coupled to the anode of the first rectifying diode of a second light-emitting module of the M light-emitting modules.

15. The light-emitting diode circuit of claim 13, wherein a M-th light-emitting module of the M light-emitting modules further comprises:

a second rectifying diode, wherein a anode of the second rectifying diode is coupled to the second terminal of the light-emitting unit of a (M−1)-th light-emitting module of the M light-emitting modules, and a cathode of the second rectifying diode is coupled to the first terminal of the light-emitting unit of the M-th light-emitting module; and a fourth switch coupled between the positive output terminal and the first terminal of the light-emitting unit of the M-th light-emitting module, and configured to be selectively turned on according to a M-th one of the first control signals, wherein the second terminal of the light-emitting unit of the M-th light-emitting module is coupled the negative output terminal.

16. The light-emitting diode circuit of claim 13, wherein a first light-emitting module and the n-th light-emitting module of the M light-emitting modules have the same circuit architecture, and the first switch of the first light-emitting module is configured to be turned on.

17. The light-emitting diode circuit of claim 13, wherein a M-th light-emitting module and the n-th light-emitting module of the M light-emitting modules have the same circuit architecture, and the second switch of the first light-emitting module is configured to be turned on.

18. The light-emitting diode circuit of claim 13, wherein the light-emitting unit comprises at least one light-emitting diode.

19. An illumination device, comprising:

a rectifier circuit having a positive output terminal and an negative output terminal, the rectifier circuit being configured to generate a driving voltage between the positive output terminal and the negative output terminal according to an input power;

a control module coupled between the positive output terminal and the negative output terminal;

M light-emitting modules, wherein each of the M light-emitting modules has a conduction voltage, and comprises a light-emitting unit that comprises at least one light-emitting diode; and a diode matrix comprising a plurality of diodes coupled between the control module and the M light-emitting modules, wherein the diode matrix further comprises:

M columns, wherein each of the M columns comprises a first column electrode line and a second column electrode line; and a plurality of rows, wherein each of the rows comprises a first row electrode line and a second row electrode line;

wherein the diodes comprise:

a plurality of first diodes, wherein a plurality of anodes of the first diodes are coupled to the first row electrode lines of the rows, respectively, and a plurality of cathodes of the first diodes are coupled to the first column electrode line of a first column of the M columns; and a plurality of second diodes, wherein a plurality of anodes of the second diodes are coupled to the second column electrode line of a M-th column of the M columns, and a plurality of cathodes of the second diodes are coupled to the second row electrode line of the rows, respectively;

wherein the control module is configured to detect the driving voltage and turn on at least one of the diodes according to the driving voltage and the conduction voltage, to control the M light-emitting modules to dynamically form S light-emitting diode strings coupled in parallel with each other;

wherein a number of the light-emitting units in each of the S light-emitting diode strings is N, and S×N=M, where M, S, N are positive integers;

wherein the light-emitting unit has a first terminal and a second terminal, and an n-th lighting module of the M lighting modules further comprises a rectifying diode;

wherein the first terminal of the light-emitting unit of the n-th lighting module is coupled to the first column electrode line of an n-th column of the M columns, and the second terminal of the light-emitting unit of the n-th lighting module is coupled to the second column electrode line of the n-th column;

wherein an anode of the rectifying diode of the n-th lighting module is coupled to the second column electrode line of the n-th column, a cathode of the rectifying diode of the n-th lighting module is coupled to the first column electrode line of a (n+1)-th column of the M columns, and n is a positive integer less than M.

20. The illumination device of claim 19, wherein the light-emitting unit has a first terminal and a second terminal, the first terminal of the light-emitting unit of a M-th light-emitting module of the M light-emitting modules is coupled to the first column electrode line of the M-th column, and the second terminal of the light-emitting unit of the M-th light-emitting module is coupled to the second column electrode line of the M-th column.

21. The illumination device of claim 19, wherein the control module comprises a plurality of driving units, the driving units are disposed corresponding to the rows, and one of the driving units comprises:

a first driver configured to be enabled according to a corresponding one of a plurality of active signals, to transmit the driving voltage to the first row electrode line of a corresponding one of the rows; and a second driver coupled between the second row electrode line of the corresponding one of the rows and the negative output terminal, and configured to be enabled according to the corresponding one of the active signals.

22. The illumination device of claim 21, wherein the control module further comprises:

a voltage dividing circuit coupled between the positive output terminal and the negative output terminal, and configured to divide the driving voltage to generate a plurality of the testing voltages;

a plurality of comparators configured to compare the testing voltages with a reference voltage, to output a plurality of detecting signals; and a plurality of logic gates configured to output the active signals according to the detecting signals.

23. The illumination device of claim 19, wherein the diodes further comprise:

a plurality of third diodes, wherein a plurality of anodes of the third diodes are coupled to the second column electrode lines of the first to a Q-th columns of the M columns, respectively, a plurality of cathodes of the third diodes are coupled to the second row electrode of a first row of the rows, and Q is a positive integer less than M; and a plurality of fourth diodes, wherein a plurality of anodes of the fourth diodes are coupled to the first row electrode line of the first row, and a plurality of cathodes of the fourth diodes are coupled to the first column electrode lines of a second to the M-th columns of the M columns, respectively.

24. The illumination device of claim 19, wherein the diodes further comprise:

a third diode, wherein an anode of the third diode is coupled to the second column electrode line of a R-th column of the M columns, a cathode of the third diode is coupled to the second row electrode line of the a R-th row of the rows, R is a factor of M, and R is not equal to 1 or M; and a fourth diode, wherein an anode of the fourth diode is coupled to the first row electrode line of the R-th row, and a cathode of the fourth diode is coupled to the first column electrode line of the a (R+1)-th column of the M columns.

25. The illumination device of claim 19, wherein the diodes further comprise:

a third diode, wherein an anode of the third diode is coupled to the second column electrode line of a T-th column of the M columns, a cathode of the third diode is coupled to the second row electrode line of a corresponding one of the rows, T is a positive integer and is a one Y-th of M, and Y is a positive integer greater than or equal to 2; and a fourth diode, wherein an anode of the fourth diode is coupled to the first row electrode line of the corresponding one of the rows, and a cathode of the fourth diode is coupled to the first column electrode line of the a (T+1)-th column of the M columns.

26. The illumination device of claim 19, wherein when the driving voltage is M times as much as the conduction voltage, the control module turns on a first one of the first diodes and a first one of the second diodes, to control the M light-emitting modules to form a light-emitting diode string, and the number of the light-emitting unit in the light-emitting diode string is M, S=1, and N=M;

wherein the first one of the first diodes is coupled between the first row electrode line of a last row of the rows and the first column electrode line of the first column, and the first one of the second diodes is coupled between the second column electrode line of the M-th column and the second row electrode line of the last row.

* * * * *